US011236969B2

(12) United States Patent
Mihara et al.

(10) Patent No.: US 11,236,969 B2
(45) Date of Patent: Feb. 1, 2022

(54) LAUNCH TUBE AND METHOD OF LAUNCHING FLYING OBJECT

(71) Applicant: MITSUBISHI HEAVY INDUSTRIES, LTD., Tokyo (JP)

(72) Inventors: Chiyako Mihara, Tokyo (JP); Katsunori Ieki, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 9 days.

(21) Appl. No.: 16/556,742

(22) Filed: Aug. 30, 2019

(65) Prior Publication Data

US 2020/0080817 A1 Mar. 12, 2020

(30) Foreign Application Priority Data

Sep. 7, 2018 (JP) ..... JP2018-168262

(51) Int. Cl.
*F41F 3/04* (2006.01)

(52) U.S. Cl.
CPC ..... *F41F 3/0406* (2013.01)

(58) Field of Classification Search
CPC ..... F41F 3/0406; F41F 3/052
USPC ..... 89/1.816, 1.819
See application file for complete search history.

(56) References Cited

U.S. PATENT DOCUMENTS 2,458,476 A * 1/1949 Lauritsen ..... F41F 3/04 89/1.806
2,870,677 A * 1/1959 Herrmann ..... F41F 3/052 89/1.806
3,659,493 A * 5/1972 Wissner ..... F41F 3/052 89/1.807
3,789,729 A * 2/1974 Aupy ..... F41F 3/042 89/1.8
4,616,554 A * 10/1986 Spink ..... F41F 3/052 89/1.806
5,353,677 A * 10/1994 Kennedy ..... F41F 3/052 89/1.8
5,400,689 A * 3/1995 Hutter ..... F41F 3/052 89/1.816
7,624,669 B2 * 12/2009 Paul ..... F41F 3/052 89/1.806
7,690,289 B2 * 4/2010 Hallgren ..... F41F 3/052 89/1.819
8,256,339 B1 * 9/2012 Hamalian ..... F41F 3/052 89/1.815

FOREIGN PATENT DOCUMENTS

JP 2004-226007 8/2004

* cited by examiner

*Primary Examiner* — Troy Chambers
*Assistant Examiner* — Benjamin S Gomberg
(74) *Attorney, Agent, or Firm* — Wenderoth, Lind & Ponack, L.L.P.

(57) ABSTRACT

A launch tube of a flying object has a tube, a plurality of rails and a plurality of guides. The tube is configured to store the flying object. The rails are fixed on an inner wall of the tube and configured to contact the flying object. The guides are on the inner wall of the tube. One of the guides is configured to contact the flying object, and evacuate from a region of movement of the flying object, when the flying object moves to leave the one of the guides.

13 Claims, 26 Drawing Sheets

LAUNCH TUBE AND METHOD OF LAUNCHING FLYING OBJECT

CROSS-REFERENCE TO RELATED APPLICATION

The present application is based on Japanese Patent Application JP 2018-168262, and claims priority therefrom. The disclosure of Japanese Patent Application JP 2018-168262 is incorporated herein by reference.

TECHNICAL FIELD

The present invention relates to a launch tube and a method of launching a flying object.

BACKGROUND ART

A launch tube is sometimes used when a flying object is launched. The flying object receives force of vibration, twist and so on when being launched from the launch tube. For this reason, 1 JP 2004-226007 A discloses a launch tube, in which rails are provided to maintain the attitude of the flying object when the flying object is launched from the launch tube. The flying object is stored in this launch tube in the condition that wings are folded. Therefore, a wing guide section is provided for this launch tube to guide the wings to maintain the attitude of the flying object.

SUMMARY OF THE INVENTION

There is a flying object in which a diameter of a front section of the flying object is smaller than that of a rear section of the flying object, such as a flying object having a multi-stage rocket motor. When such a flying object is launched from the launch tube, only the rear section having a larger diameter is guided by rails. Therefore, when the flying object is launched, force of vibration, twist and so on is applied to the front section of the flying object, so that the attitude control of the flying object is affected.

The present invention is accomplished in the view of the above situation. An object of the present invention is to provide a launch tube which can maintain the attitude of a flying object when the flying object is launched.

Other objects could be understood from the description of the following embodiments.

To achieve the above object, the launch tube of the present invention includes a tube, a plurality of rails and a plurality of guides. The tube stores the flying object. The plurality of rails are fixed on the inner wall of the tube and touch the flying object. The plurality of guides are provided for the inner wall of the tube. The first guide of the plurality of guides is provided to touch the flying object, and to evacuate from the region of movement of the flying object when the flying object moves to leave the first guide.

A method of launching a flying object according to the present invention includes maintaining an attitude of the flying object by making a plurality of rails and a plurality of guides touch the flying object, when the flying object is launched from a launch tube; and evacuating the plurality of guides from a region of movement of the flying object when the flying object moves to leave the plurality of guides. Here, the plurality of rails are fixed on an inner wall of the launch tube, and the plurality of guides are provided on the inner wall of the launch tube.

A launch tube according to another example of the present invention includes a tube, a plurality of rails and a plurality of guides. The tube stores a flying object. The plurality of rails are fixed on an inner wall of the tube and are configured to touch the flying object. The plurality of guides are provided on the inner wall of the tube. A first guide of the plurality of guides includes a supporter, an arm and a biasing device. The supporter touches the flying object. The arm supports the supporter and is provided to protrude from the inner wall of the tube. The biasing device supports the arm to be rotatable to bias to a first direction.

According to the present invention, when launching the flying object, the attitude of the flying object can be maintained.

DESCRIPTION OF THE EMBODIMENTS

Figure 1A:
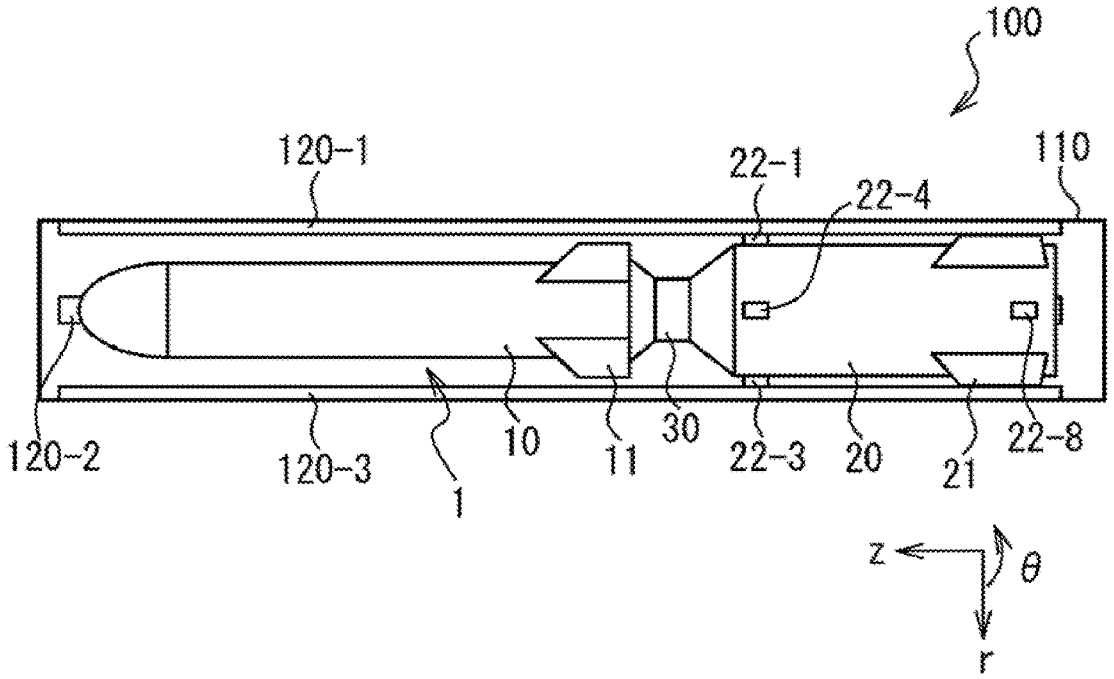
FIG. 1A is a schematic diagram showing a launch tube which guides a flying object by using rails.

A configuration of a launch tube 100 (e.g. a missile canister) which guides a rear section 20 of a flying object 1 (e.g. a missile) when launching the flying object 1, and a configuration of the flying object 1 will be described. The launch tube 100 contains a plurality of rails 120 (a first rail 120-1, a second rail 120-2, a third rail 120-3, and a fourth rail 120-4). Also, a plurality of sliders 22 (a first slider 22-1, a second slider 22-2, are provided for the flying object 1. When the flying object 1 is launched, the sliders 22 slide on the rails 120. Thus, the flying object 1 is guided and the rails 120 maintain an attitude of the flying object 1.

The detailed configuration of the flying object 1 and the launch tube 100 will be described. As shown in FIG. 1A, the flying object 1 has a front section 10, a rear section 20 and a joint section 30 which connects the front section 10 and the rear section 20. The front section 10 is provided from the rear section 20 in a progressing direction of the flying object 1. For example, when the flying object 1 has a 2-stage rocket motor, the front section 10 is a second stage rocket motor and the rear section 20 is a first stage rocket motor. To facilitate understanding, the description is made by using a circular cylinder coordinate system. It is supposed that the progressing direction of the flying object 1 is a +z direction when the flying object 1 has been stored in the launch tube 100. Also, a z axis extends to a z direction and passes through the center of the flying object 1. A radius direction orthogonal to the Z axis is an r direction. A rotation direction around the Z axis is a θ direction. In other words, the Z axis may pass through the center of the launch tube 100. Therefore, the z direction is an axial direction of a tube 110 of the launch tube 100 and the +z direction is a direction to which the flying object 1 is launched.

Figure 1B:
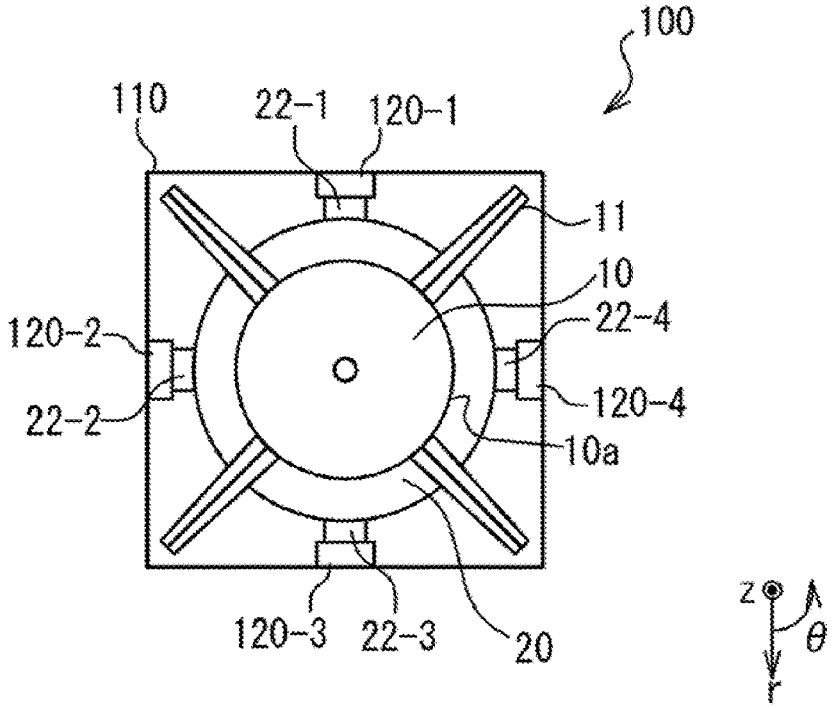
FIG. 1B is a diagram when viewing the launch tube shown in FIG. 1A to a direction opposite to a progressing direction of the flying object.

The front section 10 has a circular column shape extending to the z direction. Steering wings 11 are provided in the end portion of the front section 10 in a −z direction, as shown in FIG. 1A and FIG. 1B. The steering wing 11 is provided to protrude from a front section side surface 10*a* which is a side surface of the front section 10. As shown in FIG. 1B, the flying object 1 has been stored in the launch tube 100 so that the steering wings 11 are arranged on the diagonal lines of the launch tube 100.

The joint section 30 has a circular column shape extending to the z direction. The diameter of joint section 30 is smaller than that of the front section 10. Also, the central axis of the joint section 30 is coincides with that of the front section 10. Therefore, the side surface of the joint section 30 is separated more from an inner wall of the launch tube 100, compared with the side surface of the front section 10.

The rear section 20 has a circular column shape extending to the z direction, like the front section 10. The diameter of the rear section 20 is larger than that of the front section 10. Also, the central axis of the rear section 20 coincides with that of the front section 10. Therefore, the side surface of the rear section 20 is nearer the inner wall of the launch tube 100 than the side surface of the front section 10. Also, the rear section 20 contains the wings 21 and a plurality of sliders 22 (a first slider 22-1, a second slider 22-2, . . . ).

The wing 21 is provided to turn to the same angle as the steering wing 11 in the θ direction. Therefore, when the flying object 1 has been stored in the launch tube 100, the wings 21 are arranged on the diagonal lines of the launch tube 100.

As shown in FIG. 1B, the plurality of sliders 22 are provided to contact the rails 120 of the launch tube 100. For example, the slider 22 is provided in a middle position of two steering wings 11 in the θ direction.

As shown in FIG. 1A, the launch tube 100 has the tube 110 and the plurality of rails 120 (a first rail 120-1, a second rail 120-2, a third rail 120-3, a fourth rail 120-4). For example, as shown in FIG. 1B, the tube 110 has a rectangular cross-section such as the square.

Each of the rails 120 extends to the z direction and is fixed on the inner wall of the tube 110 on four sides. In other words, each rail 120 is provided so that the flying object 1 is put between the two opposing rails. Specifically, the first rail 120-1 and the third rail 120-3 are provided to be opposite to each other so as to put the flying object 1 between the rails 120-1 and 120-3. In the same way, the second rail 120-2 and the fourth rail 120-4 are provided to be opposite to each other so as to put the flying object 1 between the rails 120-2 and 120-4. Also, when viewing from the z direction, a line which links the first rail 120-1 and the third rail 120-3 and a line which links the second rail 120-2 and the fourth rail 120-4 may be orthogonal to each other.

When the flying object 1 is launched, the sliders 22 provided on the rear section 20 slides to the +z direction along the rails 120. Specifically, when the flying object 1 has been stored in the launch tube 100, the first rail 120-1 is arranged to contact the first slider 22-1 and the fifth slider 22-5. The second rail 120-2 is arranged to contact the second slider 22-2 and the sixth slider 22-6. The third rail 120-3 is arranged to contact the third slider 22-3 and the seventh slider 22-7. The fourth rail 120-4 is arranged to contact the fourth slider 22-4 and the eighth slider 22-8. When the flying object 1 is launched, the first slider 22-1 and the fifth slider 22-5 slide to the +z direction along the first rail 120-1. In the same way, the second slider 22-2 and the sixth slider 22-6 slide to the +z direction along the second rail 120-2. The third slider 22-3 and the seventh slider 22-7 slide to the +z direction along the third rail 120-3. The fourth slider 22-4 and the eighth slider 22-8 slide to the +z direction along the fourth rail 120-4. In this way, the flying object 1 rises in the launch tube 100 in the condition that the flying object 1 is supported from the four sides by the rails 120. Therefore, vibration, twist and so on are suppressed when the flying object 1 is launched. As a result, the attitude of the flying object 1 is maintained by the rails 120.

In this way, when the flying object 1 is launched, the rear section 20 of the flying object 1 is guided by the rails 120 of the launch tube 100.

Figure 1C:
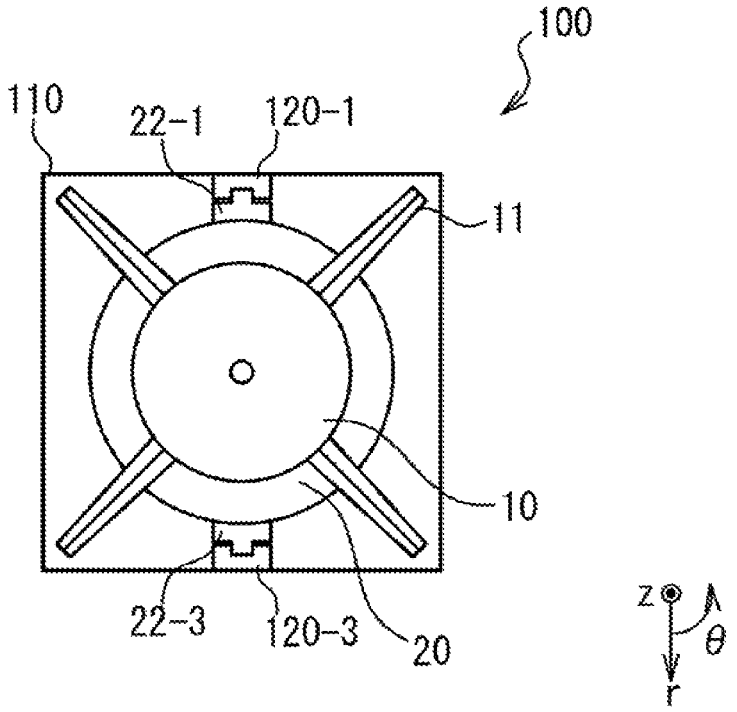
FIG. 1C is a diagram showing a modification example of the rails shown in FIG. 1A.

Here, as shown in FIG. 1C, the rail 120 may have a ditch extending to the z direction. In this case, the slider 22 is formed to fit with the ditch of the rail 120. Also, the two rails 120 (the first rail 120-1 and the third rail 120-3) are arranged to oppose to each other so as to put the flying object 1 between them. Therefore, the vibration in the direction of a line which links the first rail 120-1 and the third rail 120-3 is restrained in the rear section 20 of the flying object 1. Also, the vibration in a direction orthogonal to the line which links the first rail 120-1 and the third rail 120-3 in the rear section 20 of the flying object 1 is restrained since the ditch of the rail 120 and the slider 22 fit to each other. Therefore, since the rail 120 and the slider 22 fit to each other, the attitude of the flying object 1 can be maintained by the two rails 120 (the first rail 120-1 and the third rail 120-3).

First Embodiment

Figure 2A:
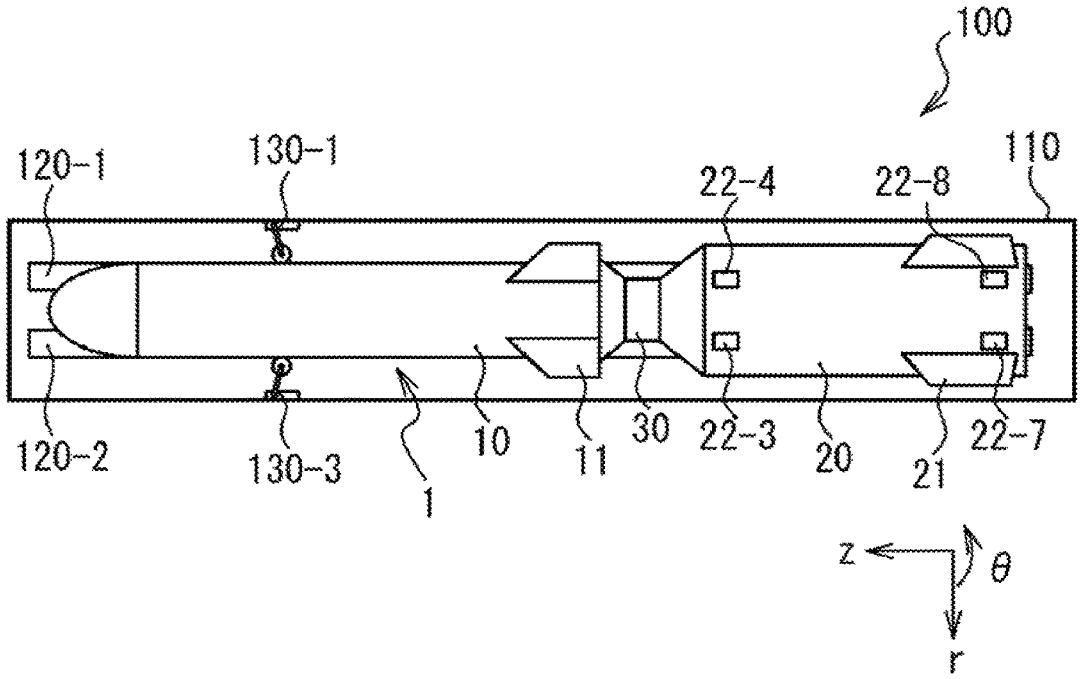
FIG. 2A is a schematic diagram showing the launch tube according to a first embodiment of the present invention.
Figure 2B:
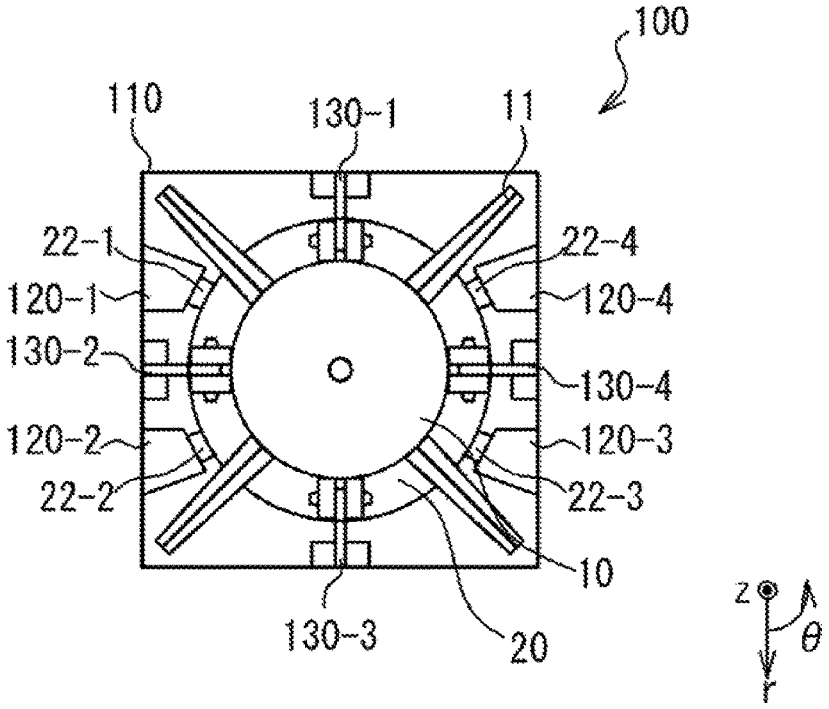
FIG. 2B is a diagram when viewing the launch tube shown in FIG. 2A to a direction opposite to the progressing direction of the flying object.

Since the diameter of the front section 10 is smaller than that of the rear section 20, the rails 120 can guide the rear section 20 but cannot guide the front section 10. Therefore, the rails 120 cannot restrain the vibration, twist and so on of the front section 10. For this reason, as shown in FIG. 2A, the launch tube 100 according to the first embodiment has a plurality of guides 130 (a first guide 130-1, a second guide 130-2, a third guide 130-3, and a fourth guide 130-4) to restrain the vibration, twist and so on of the front section 10. Also, as shown in FIG. 2B, when viewing the launch tube 100 to the −z direction, the rails 120 are arranged in positions which do not overlap with the guides 130.

The plurality of rails 120 need to be arranged in the positions to maintain the attitude of the flying object 1. For example, as shown in FIG. 2B, the first rail 120-1 and the second rail 120-2 may be provided on the same inner wall of the tube 110. In this case, the third rail 120-3 and the fourth rail 120-4 are provided on the inner wall which is opposite to the inner wall on which the first rail 120-1 and the second rail 120-2 are provided. The first rail 120-1 and the third rail 120-3 are provided to oppose to each other to put the flying object 1 between the rails 120-1 and 120-3. The second rail 120-2 and the fourth rail 120-4 are provided to oppose to each other to put the flying object 1 between the rails 120-2 and 120-4. When viewing the launch tube 100 to the −z direction, a line which links the second rail 120-2 and the fourth rail 120-4 and a line which links the first rail 120-1 and the third rail 120-3 intersect at the center of the flying object 1. By arranging the rails 120 in this way, the vibration, twist and so on when the flying object 1 is launched are restrained in the rear section 20 of the flying object 1.

The plurality of guides 130 are provide on the inner wall of the tube 110 to put the front section 10 of the flying object 1 between every two guides. Specifically, the first guide 130-1 and the third guide 130-3 are provided to oppose to each other so as to sandwich the flying object 1. In other words, the first guide 130-1 and the third guide 130-3 are arranged to be shifted by 180 degrees in the θ direction. Therefore, the first guide 130-1 and the third guide 130-3 may be arranged on the inner wall parts of the tube 110 which are opposite to each other. The second guide 130-2 and the fourth guide 130-4 are provided to oppose to each other so as to sandwich the flying object 1. In other words, the second guide 130-2 and the fourth guide 130-4 are arranged to be shifted by 180 degrees in the θ direction. Therefore, the second guide 130-2 and the fourth guide 130-4 may be arranged on the inner wall parts of the tube 110 which are opposite to each other. Also, the four guides 130 may be respectively provided on the inner wall parts on the four sides of the tube 110. In other words, when viewing the launch tube 100 to the −z direction, the line which links the first guide 130-1 and the third guide 130-3 may be orthogonal to the line which links the second guide 130-2 and the fourth guide 130-4.

Also, the four guides 130 hold the front section 10 of the flying object 1 to restrain the vibration, twist and so on of the front section 10, so as to maintain the attitude of the front section 10. Therefore, each guide 130 is arranged in the same position on a plane orthogonal to the z direction. Moreover, each guide 130 in the z direction may be provided in the +z direction from the center of gravity of the flying object 1 to hold the front section 10 by the guides 130. To maintain the attitude of the front section 10 when the flying object 1 is launched, the position of each guide 130 in the z direction may be provided at the position of the center of gravity of the front section 10. Also, since the flying object 1 moves to the +z direction, the position of each guide 130 in the z direction may be provided on the side of the +z direction from the center of gravity of the front section 10.

Also, the diameter of the front section 10 is smaller than that of the rear section 20. Therefore, when the flying object 1 is stored in the launch tube 100, a distance from the center of the flying object 1 to the rail 120 in the r direction is greater than a distance from the center of the flying object 1 to the guide 130. In other words, when viewing to the −z direction, a distance from the center of tube 110 to the guide 130 which is the nearest to this center is shorter than a distance from the center of tube 110 to the rail 120 which is the nearest to this center.

Figure 3A:
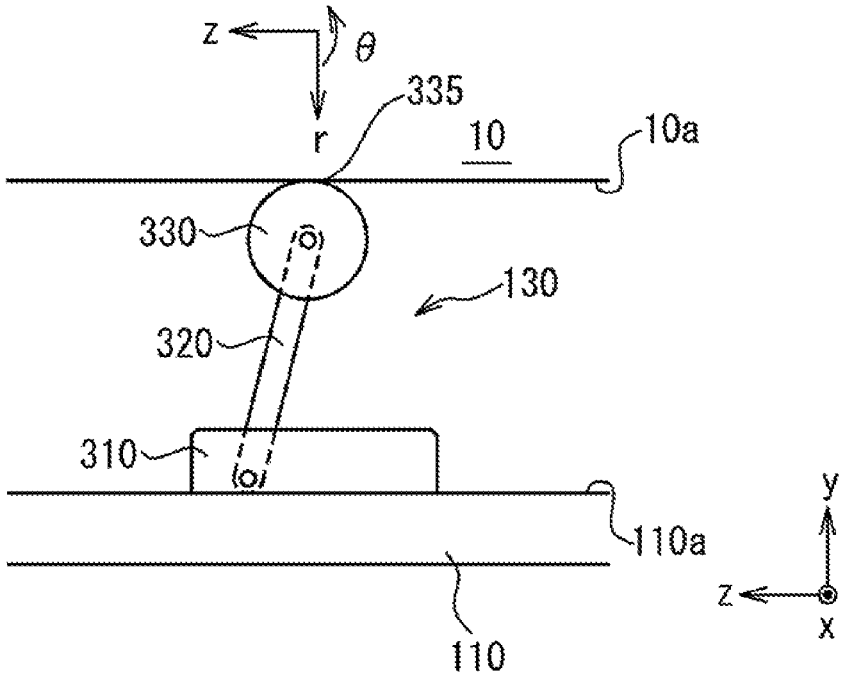
FIG. 3A is a schematic diagram of a guide shown in FIG. 2A.

The detailed configuration of guide 130 will be described. As shown in FIG. 3A, the guide 130 has a biasing device 310, an arm 320 and a supporter 330. When the flying object 1 has been stored in the launch tube 100, the supporter 330 is in contact with a side surface 10*a* of the front section 10. When the flying object 1 is launched, the front section side surface 10*a* moves to its progressing direction. Therefore, the supporter 330 is configured to be able to be brought into contact with the front section side surface 10*a* without obstructing the movement of the front section side surface 10*a*. As a result, when the flying object 1 is launched, the supporter 330 of each guide 130 is brought into contact with the front section side surface 10*a* to maintain the attitude of the front section 10.

Each section of guide 130 will be described in detail. In the description of the guide 130, the rectangular coordinates system is used to facilitate understanding. As shown in FIG. 3A, the progressing direction of the flying object 1, i.e. the +z direction of the circular cylinder coordinate system is determined as the +z direction of the rectangular coordinates system. The +y direction is a direction orthogonal to the z direction and heading for the center of tube 110 from the inner wall 110*a* of tube 110. The x direction is a direction orthogonal to the y direction and the z direction. For example, the x direction is a direction orthogonal to the z direction and parallel to the inner wall 110*a* where the guide 130 is set.

Figure 3B:
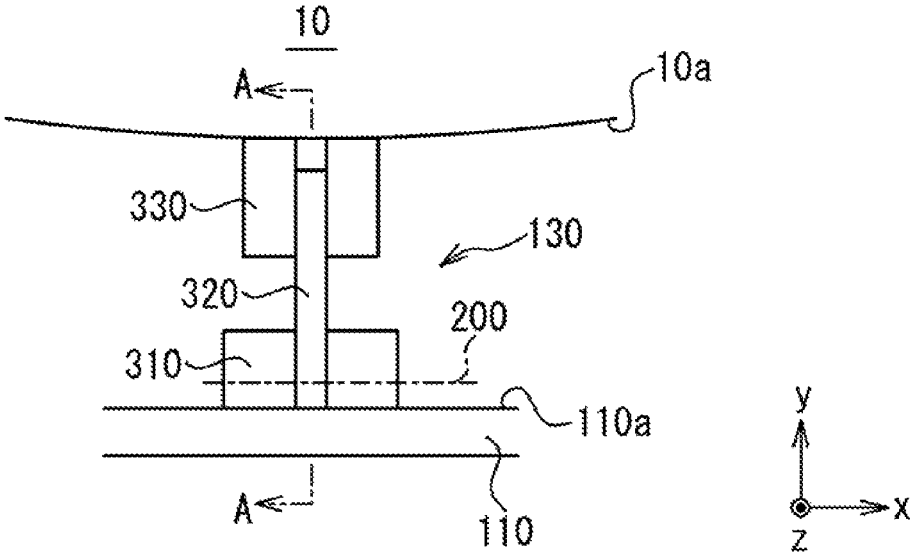
FIG. 3B is a diagram when viewing the guide shown in FIG. 3A to the direction opposite to the progressing direction of the flying object.

The biasing device 310 is supported by the inner wall 110*a* of tube 110. Also, the biasing device 310 supports the arm 320 to be rotatable. As shown in FIG. 3B, the rotation axis 200 of the arm 320 is orthogonal to the z direction and parallel to the inner wall 110*a*. Also, the rotation axis 200 of the arm 320 may be orthogonal to the z direction and parallel to a tangential plane to the front section side surface 10*a* at a contact point 335 between the front section side surface 10*a* and the supporter 330. Therefore, the arm 320 can be rotated for the inner wall 110*a* around the rotation axis 200 to the +z direction from a state shown in FIG. 3A. In other words, the arm 320 can be rotated around the rotation axis 200 to a direction away from the front section side surface 10*a*. Also, the biasing device 310 may apply a rotation force to the arm 320 such that the arm 320 is rotated to the +z direction around the rotation axis 200. The rotation force may be generated by an optional method such as a spring force and a gas pressure force.

When the attitude of the flying object 1 should be maintained, the arm 320 is installed to protrude from the inner wall 110*a*. Also, when viewing to the −z direction, the arm 320 extends to a direction orthogonal to the tangential plane of the front section side surface 10*a* at the contact point 335. Moreover, the arm 320 supports the supporter 330 to be rotatable. The rotation range of arm 320 will be described later.

When the flying object 1 is launched, the supporter 330 is configured to be brought into contact with the front section side surface 10*a* without obstructing the movement of the front section side surface 10*a*. For this purpose, the supporter 330 has a circular column shape and rotates according to the movement of front section side surface 10*a*. The rotation axis of supporter 330 is parallel to the x direction and may be the central axis of the circular column shape. Also, as shown in FIG. 3B, the supporter 330 may have two circular columns. These two circular columns may be arranged to hold the arm 320 therebetween.

(Rotation Range of Arm)

Figure 3C:
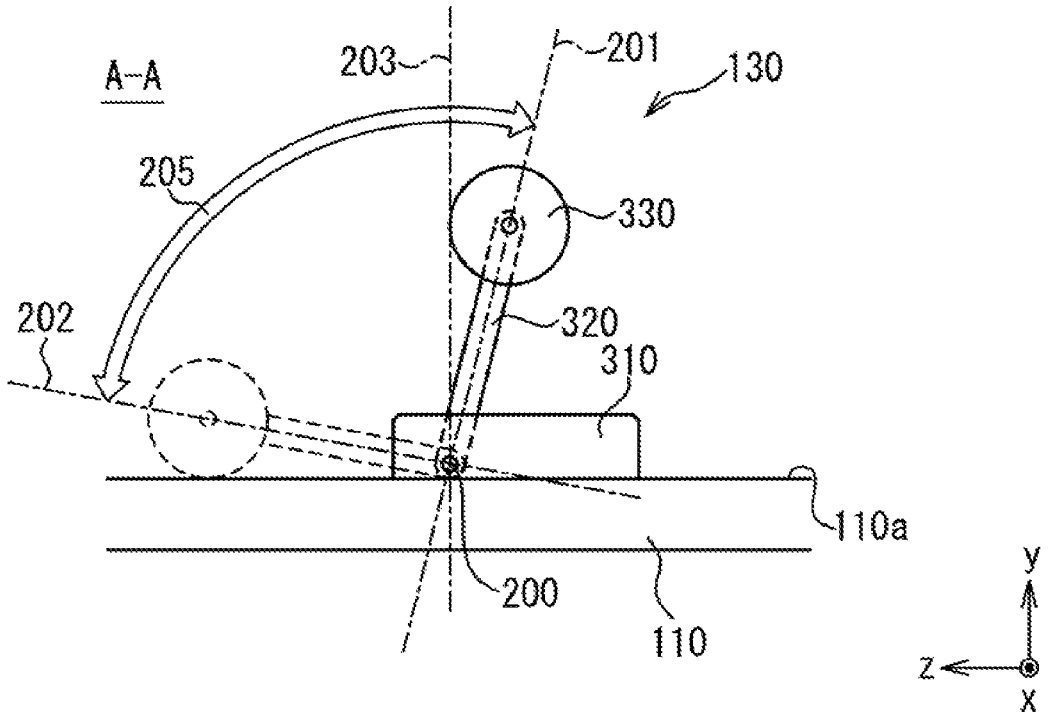
FIG. 3C is a cross-sectional view showing a rotation range of an arm shown in FIG. 2A along the line A-A in FIG. 3B.

The rotation range of arm 320 will be described. As shown in FIG. 3C, a direction of the arm 320 when the supporter 330 maintains the attitude of the flying object 1 is referred to as an arm protruding direction 201. In other words, the arm protruding direction 201 is a direction which heads for the connection position of the arm 320 and the supporter 330 from the connection position of the arm 320 and the biasing device 310. Also, a direction of the arm 320 when the supporter 330 touches the inner wall 110*a* is referred to as an arm evacuation direction 202. In this case, the arm 320 can rotate in a rotation range 205 from the arm protruding direction 201 to the arm evacuation direction 202. Here, a line which passes through the rotation axis 200 and is parallel to a normal line to the inner wall 110*a* is supposed to be referred to as an inner wall normal line 203. In this case, the arm protruding direction 201 is inclined to the −z direction from the inner wall normal line 203. In other words, the rotation range 205 is wider than a range from the arm evacuation direction 202 to the inner wall normal line 203. Also, when the supporters 330 maintain the attitude of the flying object 1, the end of the supporter 330 in the +z direction may be above the position of rotation axis 200.

Figure 3D:
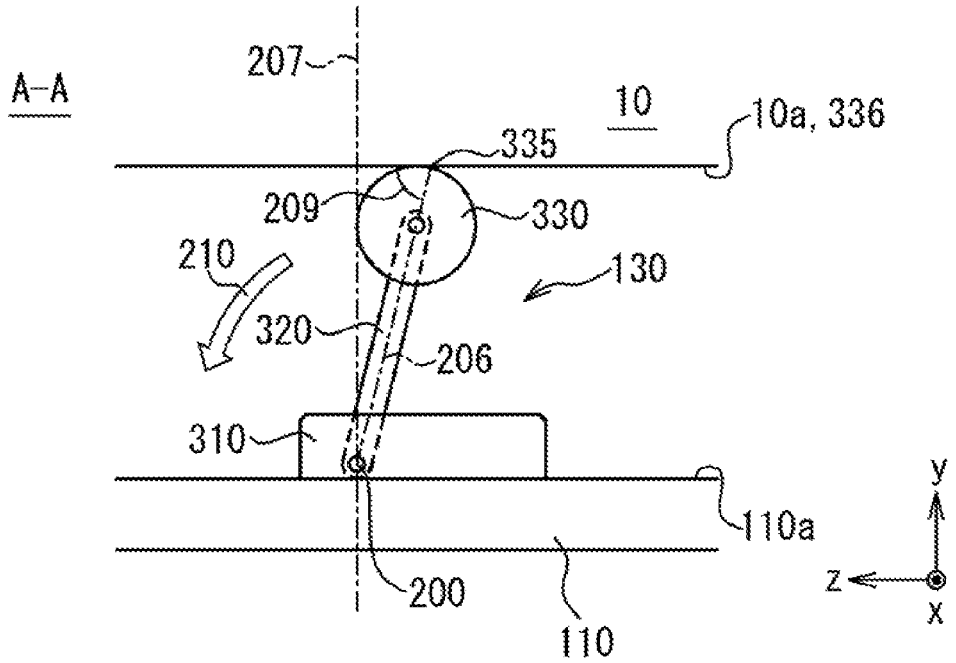
FIG. 3D is a cross-sectional view showing the arm in FIG. 2A along the line A-A in FIG. 3B.

Also, the direction of arm 320 when the supporters 330 maintain the attitude of the flying object 1 will be described based on the front section side surface 10*a* of the flying object 1. As shown in FIG. 3D, a line segment which links the rotation axis 200 and the contact point 335 of the supporter 330 with the front section side surface 10*a* when the supporters 330 maintain the attitude of the flying object 1 is supposed to be referred to as a contact point line segment 206. An angle between the contact point line segment 206 and the tangential plane to the front section side surface 10*a* at the contact point 335 is supposed to be referred to as an arm angle 209. In this case, defining as a contact point intersection line 336, an intersection line of the tangential plane to the front section side surface 10*a* at the contact point 335 and a plane which is orthogonal to the rotation axis 200 and passes through the contact point 335, this arm angle 209 can be said as an angle between the contact point intersection line 336 and the contact point line segment 206. The arm angle 209 shows an angle in the +z direction and may be smaller than 90 degrees. When the arm angle is smaller than 90 degrees, the supporter 330 contacts the front section side surface 10*a* so that the arm 320 cannot be rotated even if the biasing device 310 tries to rotate the arm 320 to the rotation direction 210.

Also, a line which passes through the rotation axis 200 and is orthogonal to the tangential plane to the front section side surface 10*a* at the contact point 335 is supposed to be referred to as a tangential plane normal line 207. This tangential plane normal line 207 is orthogonal to the contact point intersection line 336 and passes through the rotation axis 200. When the supporters 330 maintain the attitude of the flying object 1, the end of supporter 330 in the +z direction may come in contact with the tangential plane normal line 207. In other words, viewing to a direction parallel to the rotation axis 200 when the supporter 330 maintains the attitude of the flying object 1, the end of the supporter 330 in the +z direction may be on the position of the rotation axis 200 in the z direction. In other words, viewing to the direction parallel to the rotation axis 200 when the supporters 330 maintain the attitude of the flying object 1, the end of the supporter 330 in the +z direction may be on the position of the rotation axis 200 in the direction to which the contact point intersection line 336 extends.

(Movement of Guide)

Figure 4A:
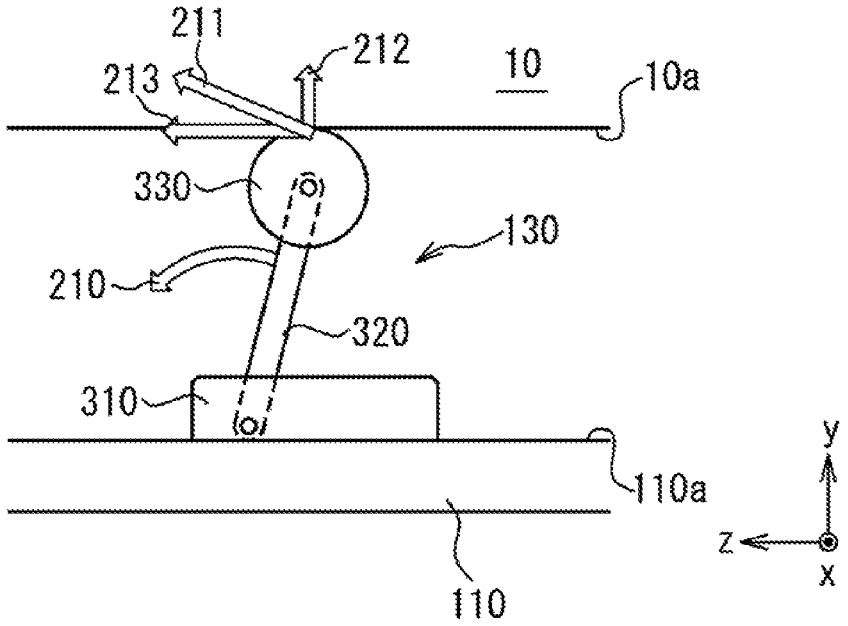
FIG. 4A is a diagram showing a movement of the guide shown in FIG. 2A.

Next, the movement by which the guide 130 guides the flying object 1 when the flying object 1 is launched, that is, a method of launching the flying object 1 will be described. As shown in FIG. 4A, when the flying object 1 is launched, the biasing device 310 applies the rotation force to the rotation direction 210 to the arm 320. For example, the biasing device 310 applies the rotation force to the arm 320 until the flying object 1 is launched after the flying object 1 has been stored in the launch tube 100. In more detailed, the biasing device 310 applies the rotation force to the arm 320 until the flying object 1 leaves the launch tube 100. By the rotation force applied to the arm 320, the rotation force in the rotation direction 210 is applied to the supporter 330. However, the supporter 330 is obstructed by the front section side surface 10*a* of the flying object 1 so that it cannot rotate, when the flying object 1 has been stored in the launch tube 100. Therefore, a pushing force 211 is applied to the front section side surface 10*a* of the flying object 1. The pushing force 211 can be shown by a parallel component 213 parallel to the front section side surface 10*a* and an orthogonal component 212 orthogonal to the front section side surface 10*a*. In other words, the biasing device 310 biases the arm 320 to the rotation direction 210 to push the supporter 330 against the front section side surface 10*a* of the flying object 1 with the orthogonal component 212.

Figure 4B:
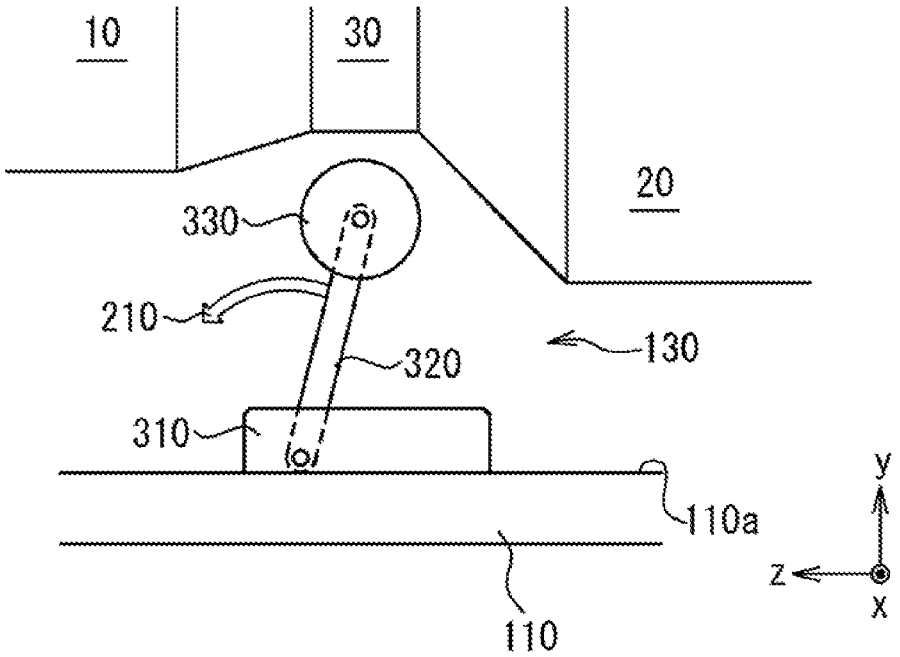
FIG. 4B is a diagram showing the movement of the guide shown in FIG. 2A.

When the flying object 1 is launched, the flying object 1 moves to the progressing direction, i.e. the +z direction. The supporter 330 continues to contact the front section side surface 10*a* of the flying object 1 until the joint section 30 reaches the position of the guide 130. In this case, the side surface of the joint section 30 is separate from the inner wall 110*a* more than the side surface 10*a* of the front section 10. Therefore, as shown in FIG. 4B, when the joint section 30 reaches the position of the guide 130, the supporter 330 leaves the side surface 10*a* of the flying object 1. As a result, the biasing device 310 can rotate the arm 320 from the arm protruding direction 201 to the rotation direction 210. By rotating the arm 320 by the biasing device 310, the supporter 330 moves to the direction of the inner wall 110*a* and touches the inner wall 110*a*.

Figure 4C:
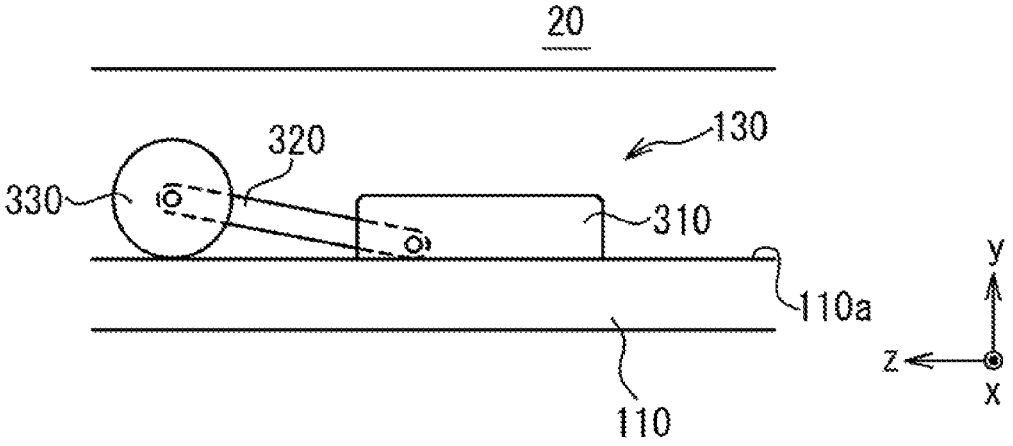
FIG. 4C is a diagram showing the movement of the guide shown in FIG. 2A.

The flying object 1 further moves and the rear section 20 reaches the position of the guide 130. In this case, the side surface of the rear section 20 is nearer to the inner wall 110*a* than the side surface of the front section 10. Therefore, when the arm 320 directs to the arm protruding direction 201, the guide 130 contacts the rear section 20 to obstruct the movement of the flying object 1. However, when the guide 130 reaches the joint section 30, the arm 320 is rotated to the arm evacuation direction 202. Therefore, the distance to the guide 130 from the line which passes through the center of the flying object 1 and is parallel to the z direction, that is, the distance to the guide 130 from the center of the flying object 1 in the r direction becomes larger. In other words, because the shortest distance to the guide 130 from the line which passes through the central axis of the launch tube 100 and is parallel to the z direction becomes longer, the guide 130 deviates from a region through which the flying object 1 passes. As a result, as shown in FIG. 4C, the guide 130 is evacuated in the neighborhood of the inner wall 110*a* such that the guide 130 does not contact the rear section 20. In other words, the flying object 1 can be launched from the launch tube 100 without obstruction of the movement of the flying object 1 by the guide 130.

As mentioned above, since the launch tube 100 has the guide 130, the attitude of the flying object 1 can be maintained when the flying object 1 is launched. Therefore, even when the flying object 1 leaves the launch tube 100, the attitude of the flying object 1 is maintained. As a result, the precision of the attitude control of the flying object 1 is improved, and a probability that the flying object 1 reaches a target position is improved. Also, when the flying object 1 moves so that the flying object 1 leaves the guide 130, the guide 130 evacuates from the moving region of the flying object 1. As a result, the guide 130 does not obstruct the movement of the flying object 1.

Next, an operation when the flying object 1 is stored in the launch tube 100 will be described. The flying object 1 is moved to the −z direction in the launch tube 100 and is stored in the launch tube 100. At this time, when the arm 320 is directed to the arm protruding direction 201, the guide 130 obstructs the movement of the rear section 20 of the flying object 1. Therefore, after the flying object 1 is stored, the arm 320 is rotated to the arm protruding direction 201.

Figure 5:
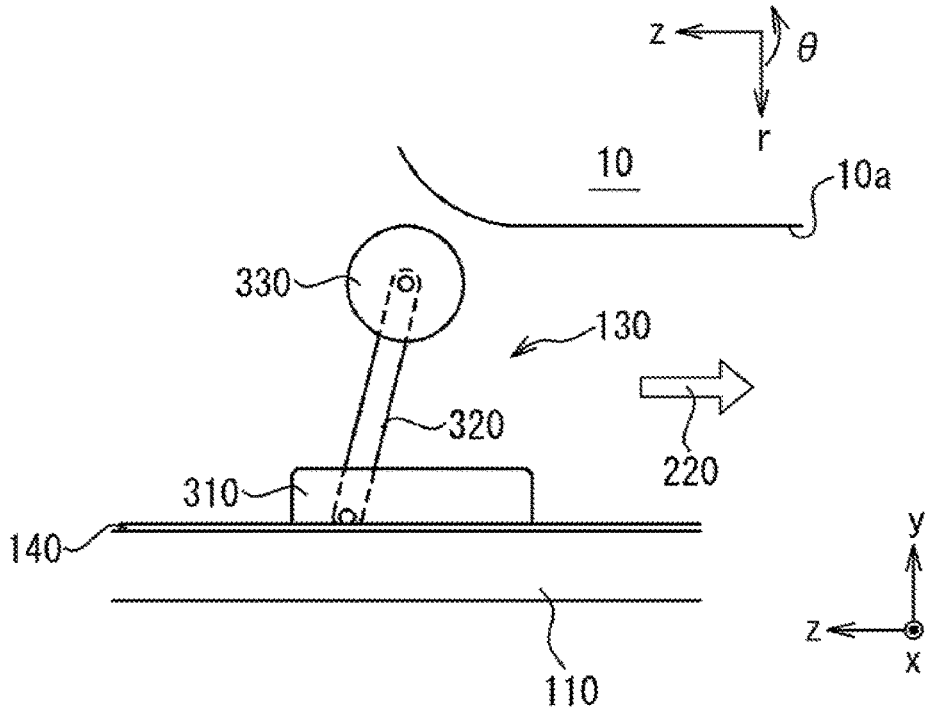
FIG. 5 is a diagram showing an installation method of the guide shown in FIG. 2A.

For example, as shown in FIG. 5, the launch tube 100 may have an arranging rail 140 to slide the guide 130 to a slide direction 220. In other words, the guide 130 may be provided for the inner wall 110*a* of tube 110 to be slidable to the slide direction 220. After the flying object 1 has been stored in the launch tube 100, the guide 130 is arranged in a desired position along the arranging rail 140. At this time, the arm 320 moves on the arranging rail 140 in a condition directed to the arm protruding direction 201. Thus, the guide 130 can be arranged in the desired position in the condition that the supporter 330 is contacted with the front section side surface 10*a*. After arranging the guide 130 in the desired position, the position of the guide 130 is fixed. Here, the slide direction 220 may be the z direction.

Figure 6:
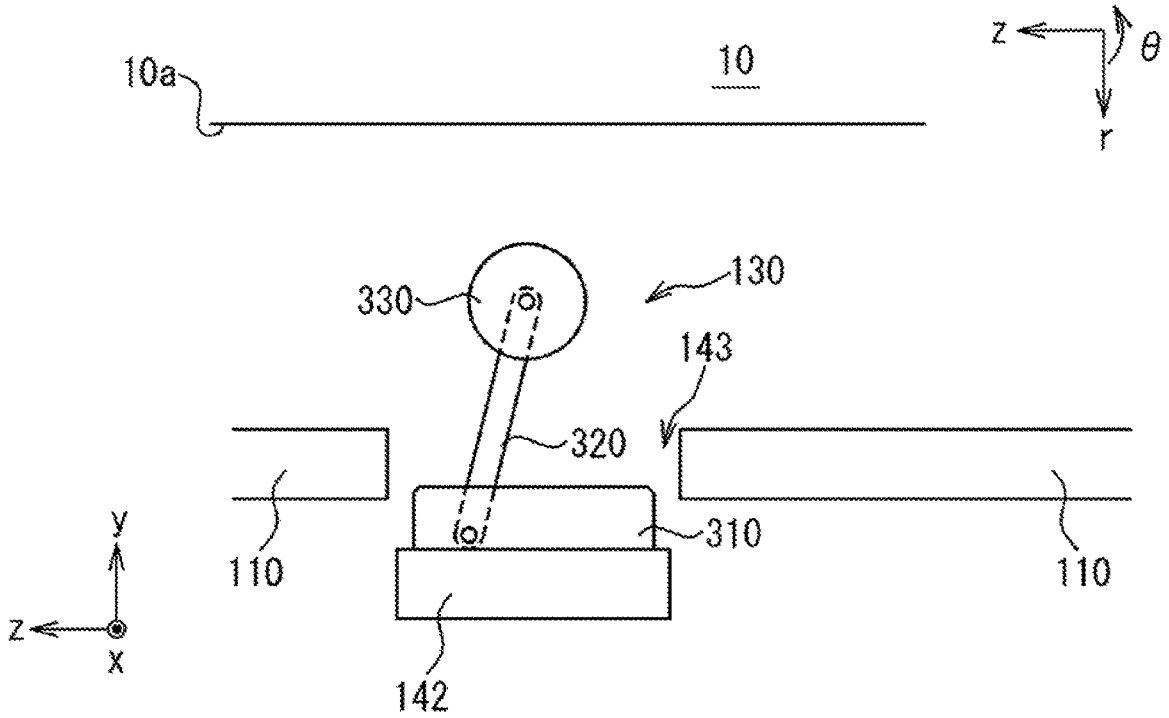
FIG. 6 is a diagram showing the installation method of the guide shown in FIG. 2A.

Also, as shown in FIG. 6, an opening 143 may be provided for the tube 110 and a separation wall 142 in which the guide 130 has been provided may be detachably arranged in the opening 143. In this case, the separation wall 142 can close the opening 143 formed in the inner wall 110*a*. Therefore, after the flying object 1 is stored in the launch tube 100, the separation wall 142 in which the guide 130 has been provided is fixed to the opening 143. At this time, the arm 320 is fixed in the condition that the arm is directed to the arm protruding direction 201. Thus, the guide 130 is arranged in the condition that the arm 320 is directed to the arm protruding direction 201.

Figure 7:
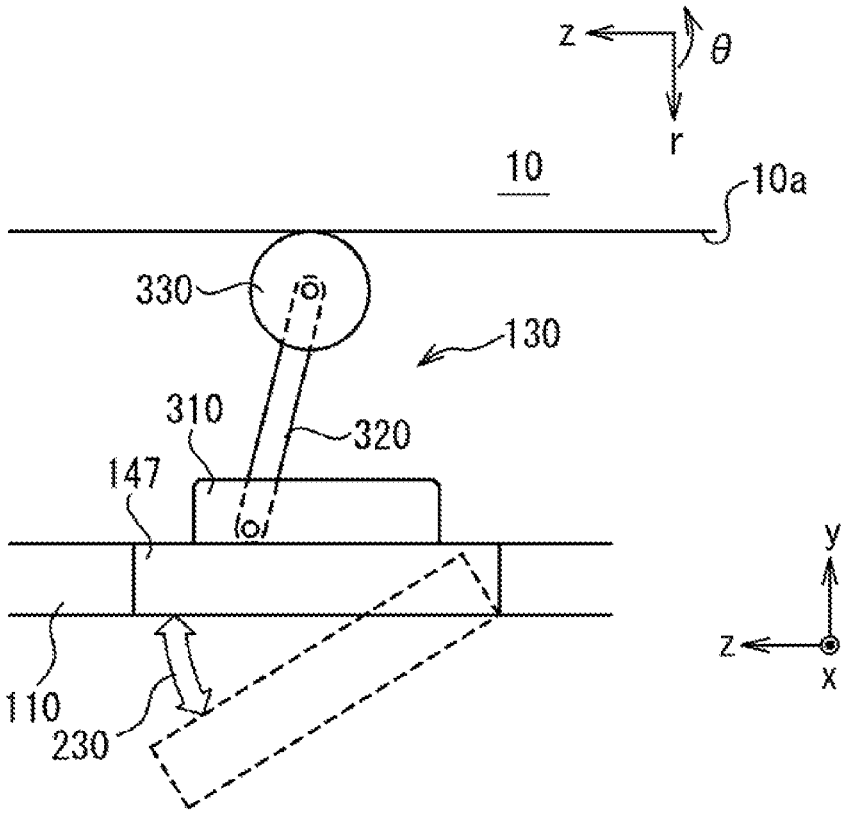
FIG. 7 is a diagram showing the installation method of the guide shown in FIG. 2A.
Figure 8A:
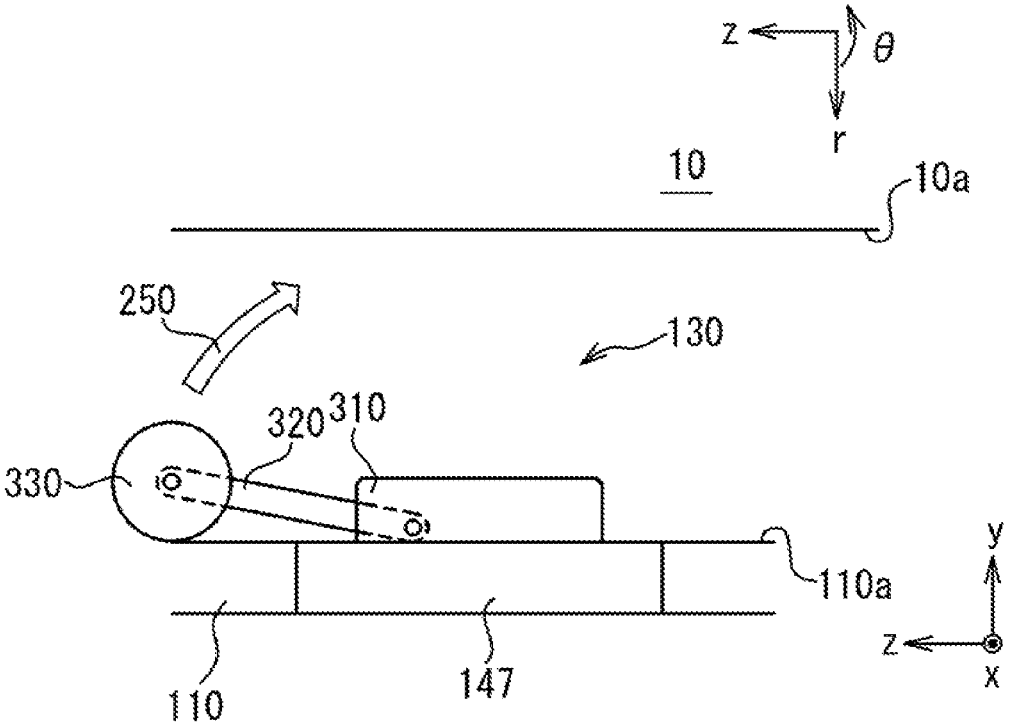
FIG. 8A is a diagram showing an operation when installing the guide shown in FIG. 7.
Figure 8B:
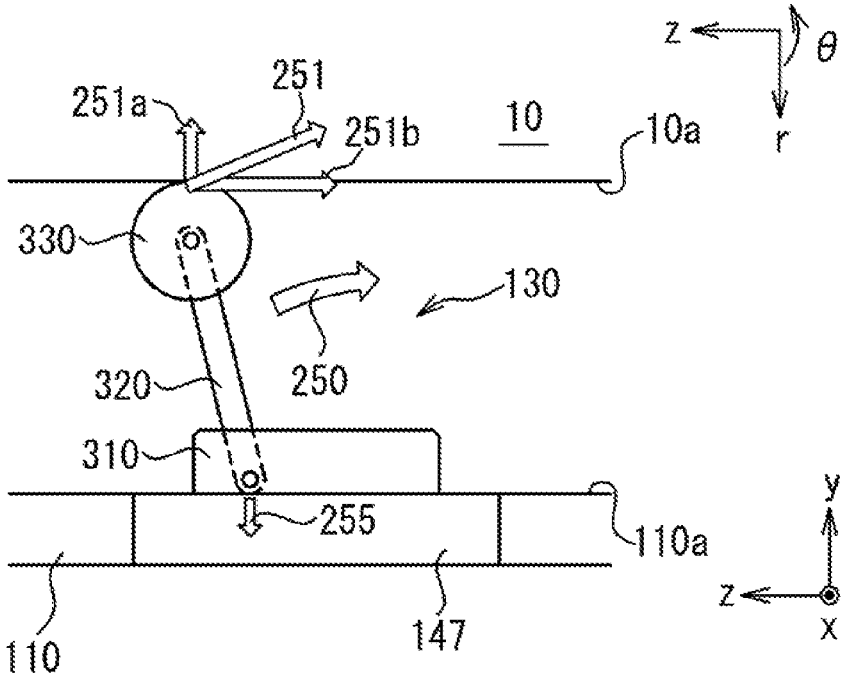
FIG. 8B is a diagram showing the operation when installing the guide shown in FIG. 7.
Figure 8C:
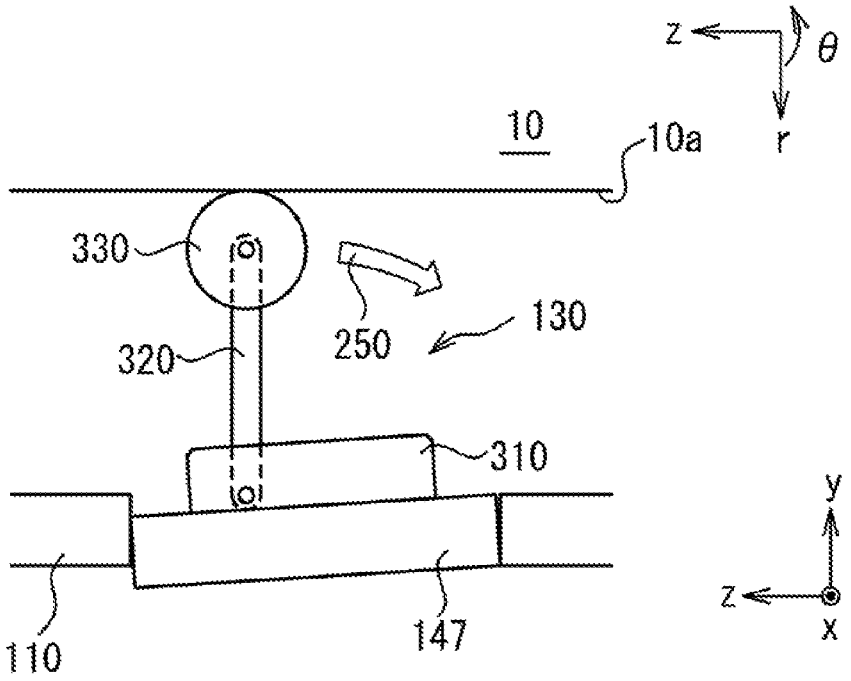
FIG. 8C is a diagram showing the operation when installing the guide shown in FIG. 7.
Figure 8D:
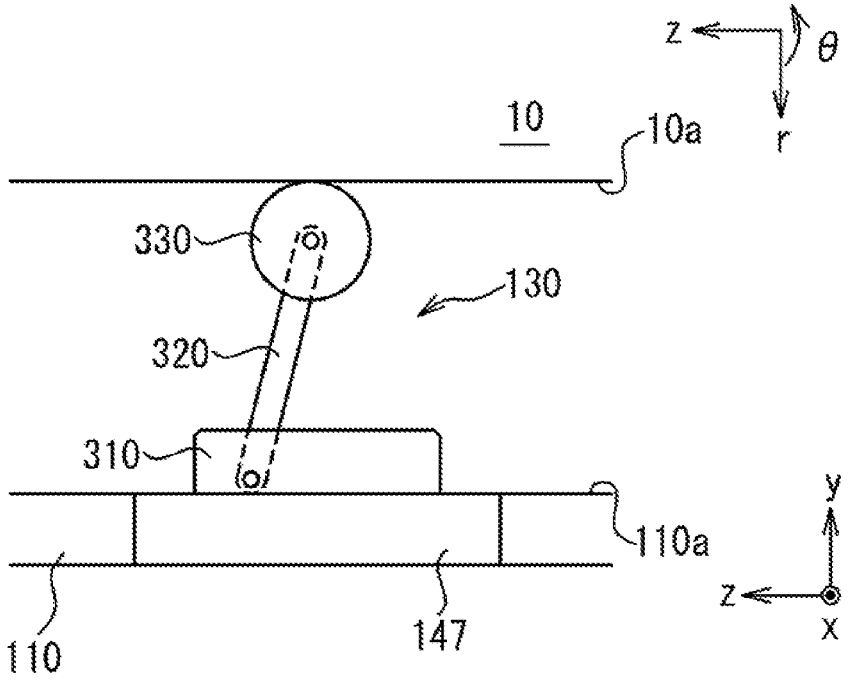
FIG. 8D is a diagram showing the operation when installing the guide shown in FIG. 7.

Moreover, as shown in FIG. 7, the tube 110 may have a door 147 in the position where the guide 130 is arranged. One end of the door 147 in the +z direction or the −z direction is connected with the tube 110 to be rotatable in a movable direction 230. In other words, the door 147 is provided to be possible to open to the outside direction of the tube 110. In this case, the flying object 1 is stored in the launch tube 100 in the condition that the arm 320 is directed to the arm evacuation direction 202. After that, as shown in FIG. 8A, the biasing device 310 rotates the arm 320 to the −z direction, i.e. to a setting direction 250. When the biasing device 310 rotates the arm 320 to the direction protruding from the inner wall 110*a*, the supporter 330 contacts the front section side surface 10*a* of the flying object 1, as shown in FIG. 8B. When the biasing device 310 further rotates the arm 320 to the setting direction 250, the supporter 330 applies a pushing force 251 to the front section side surface 10*a*. The pushing force 251 is a resultant force of a parallel component 251*b* parallel to the front section side surface 10*a* and an orthogonal component 251*a* orthogonal to the front section side surface 10*a*. Due to the reaction of the orthogonal component 251*a*, the guide 130 receives a reaction force 255 in the −y direction. As a result, as shown in FIG. 8C, the door 147 is rotated to the outside direction of the tube 110. Thus, the biasing device 310 can further turn the arm 320 to the setting direction 250. As shown in FIG. 8D, the arm 320 is rotated until the arm 320 is directed to the arm protruding direction 201. When the arm 320 has been directed to the arm protruding direction 201, the door 147 is fixed so as not to be turned.

As mentioned above, the flying object 1 can be stored in the launch tube 100. By launching the flying object 1 stored in this way from the launch tube 100, the attitude of the front section 10 of the flying object 1 can be maintained.

Second Embodiment

Figure 9A:
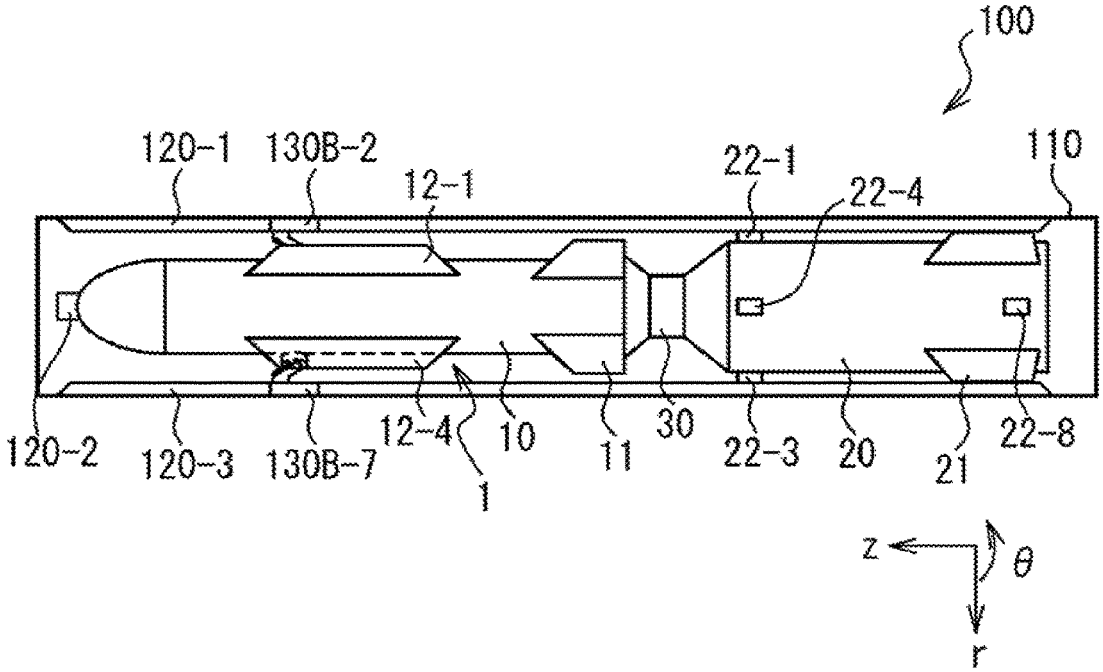
FIG. 9A is a schematic diagram showing the launch tube according to a second embodiment.
Figure 9B:
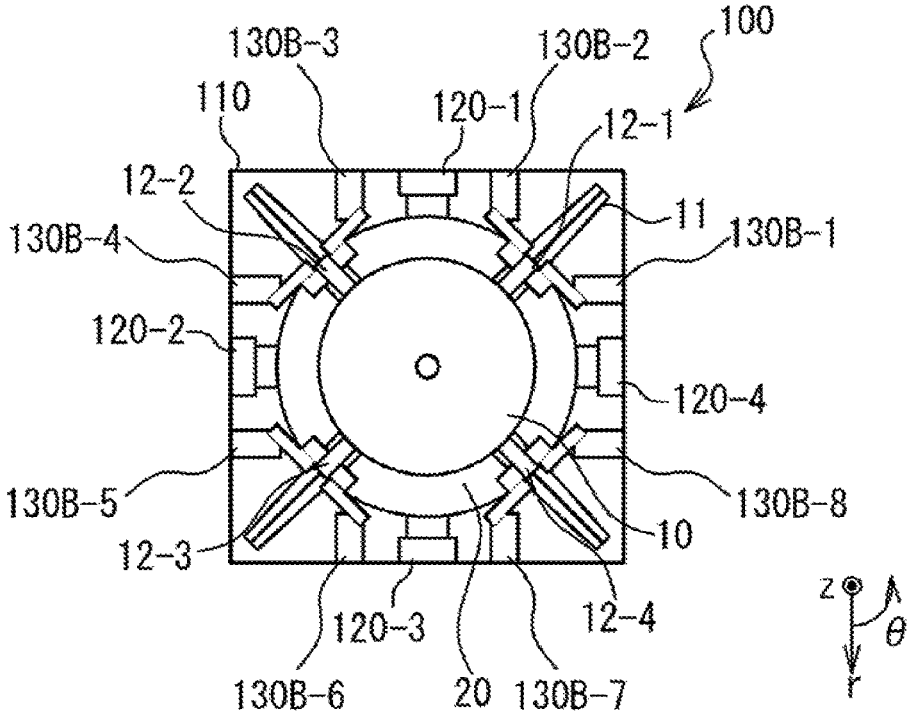
FIG. 9B is a diagram when viewing the launch tube shown in FIG. 9A to a direction opposite to the progressing direction of the flying object.

In the first embodiment, an example has been shown in which the guides 130 contact the front section side surface 10*a* to maintain the attitude of the front section 10 of the flying object 1. As shown in FIG. 9A and FIG. 9B, when the flying object 1 has dorsal fins 12, the guides 130B contact the dorsal fins 12, so that the attitude of the flying object 1 is maintained.

The flying object 1 according to the second embodiment has a plurality of dorsal fins 12 (a first dorsal fin 12-1, a second dorsal fin 12-2, a third dorsal fin 12-3, and a fourth dorsal fin 12-4). Each of the dorsal fins 12 is provided to protrude from the side surface of the front section 10. When viewing to a direction opposite to the progressing direction of the flying object 1, each dorsal fin 12 is provided in the same direction as the steering wing 11 in the θ direction. Therefore, when the flying object 1 has been stored in the launch tube 100, the dorsal fins 12 are arranged on the diagonal lines of the launch tube 100. Also, an angle between a dorsal fin side surface 12*a* as the side surface of dorsal fin 12 and the inner wall 110*a* of the tube 110 may be larger than 30 degrees, and the angle may be smaller than 55 degrees. Also, the angle between the dorsal fin side surface 12*a* and the inner wall 110*a* of the tube 110 may be larger than 35 degrees and may be smaller than 50 degrees. Moreover, it may be larger than 40 degrees and smaller than 45 degrees.

The guide 130B is arranged to be able to contact the dorsal fin side surface 12*a*. Specifically, the first guide 130B-1 and the second guide 130B-2 are provided to oppose to each other so as to put the first dorsal fin 12-1 therebetween. In the same way, the third the guide 130B-3 and the fourth the guide 130B-4 are provided to oppose to each other so as to put the second dorsal fin 12-2 therebetween. In the same way, the fifth the guide 130B-5 and the sixth the guide 130B-6 are provided to oppose to each other so as to put the third dorsal fin 12-3 therebetween. In the same way, the seventh the guide 130B-7 and the eighth the guide 130B-8 are provided to oppose to each other so as to put the fourth dorsal fin 12-4 therebetween. In other words, each dorsal fin 12 is put between the two guides 130B.

In this way, by putting each dorsal fin 12 between the two guides 130B, the vibration, twist and so on of the front section 10 of the flying object 1 is restrained and the attitude of the front section 10 is maintained. Therefore, each guide 130B is arranged in the same position in the z direction, like the first embodiment. Moreover, the position of each guide 130B in the z direction may be provided on the side in the +z direction from the center of gravity of the flying object 1. The position of each guide 130B in the z direction may be provided on the side in the +z direction from the center of gravity position of the front section 10.

Also, the diameter of the front section 10 is smaller than that of the rear section 20. Therefore, the distance from the center of the flying object 1 to the rail 120 in the r direction may be longer than the distance from the center of the flying object 1 to the guide 130B. In other words, when viewing to a direction opposite to the z direction, the shortest distance from the center of the tube 110 to the rail 120 may be longer than the shortest distance from the center of tube 110 to the guide 130B.

The other configuration is same as that of the first embodiment.

Figure 10A:
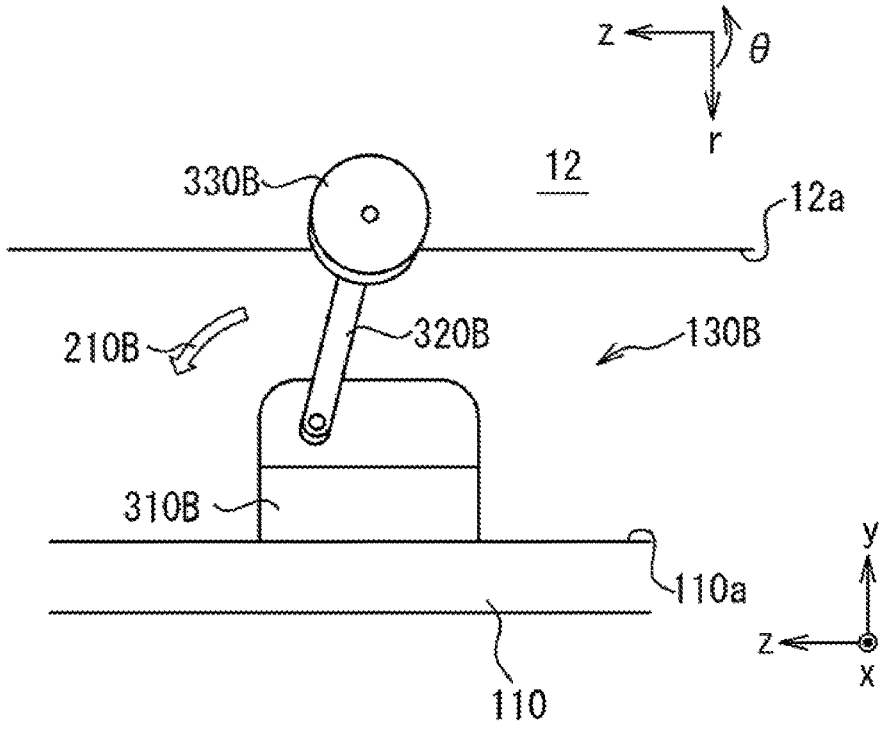
FIG. 10A is a schematic diagram showing the guide shown in FIG. 9A.

The configuration of the guide 130B will be described in detail. As shown in FIG. 10A, the guide 130B has a biasing device 310B, an arm 320B and a supporter 330B. When the flying object 1 is launched, the supporter 330B touches the dorsal fin 12 to maintain the attitude of the front section 10.

Figure 10B:
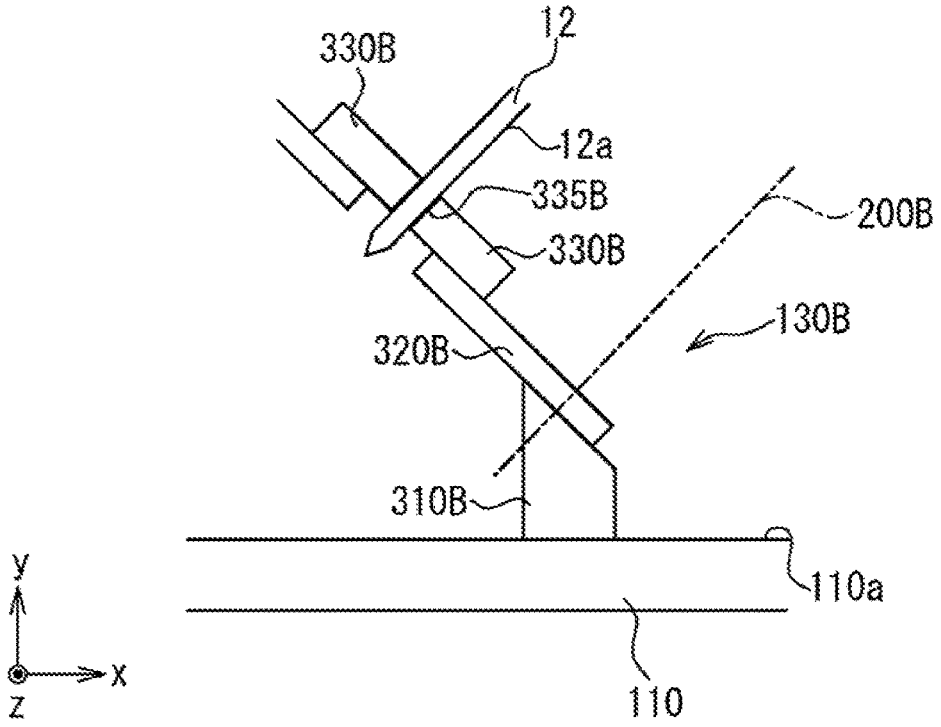
FIG. 10B is a diagram when viewing the guide shown in FIG. 10A to the direction opposite to the progressing direction of the flying object.

Each section of the guide 130B will be described in detail. The biasing device 310B is supported to the inner wall 110*a* of the tube 110. Also, the biasing device 310B supports the arm 320B to be rotatable. As shown in FIG. 10B, the direction of the rotation axis 200B of the arm 320B is orthogonal to the z direction and is parallel to the dorsal fin side surface 12*a*. In other words, the direction of the rotation axis 200B is orthogonal to the z direction and is parallel to the tangential plane of the dorsal fin 12 at a contact point 335B of the dorsal fin 12 and the supporter 330B. Therefore, the arm 320B can rotate from the state of FIG. 10A to a rotation direction 210B. In other words, the arm 320B is possible to be inclined to the progressing direction of the flying object 1 for the inner wall 110*a*. Further, in other words, the arm 320B can be inclined to a direction away from the dorsal fin side surface 12*a*. The arm 320B may be inclined until the arm 320B touches the inner wall 110*a*. Also, the biasing device 310B may apply the rotation force to the arm 320B so that the arm 320B is inclined to the +z direction. The rotation force can be generated by an optional method such as a spring force and a gas pressure force.

When the attitude of the flying object 1 is maintained, the arm 320B is provided to protrude from the inner wall 110*a*. Also, when viewing to a direction opposite to the z direction, the arm 320B extends to a direction orthogonal to the dorsal fin side surface 12*a*. In other words, the arm 320B extends to a direction orthogonal to the tangential plane of the dorsal fin side surface 12*a* at the contact point 335B. Moreover, the arm 320B supports the supporter 330B to be rotatable. The rotation range of the arm 320B will be described later.

When the flying object 1 is launched, the supporter 330B is configured to contact the dorsal fin side surface 12*a* without obstructing the movement of the dorsal fin side surface 12*a*, like the first embodiment. Therefore, the supporter 330B has a circular column shape and rotates according to the movement of the dorsal fin side surface 12*a*. The rotation axis of the supporter 330B may be a central axis of the circular column shape.

(Rotation Range of Arm)

The rotation range of arm 320B will be described. The arm 320B is possible to rotate from the position when the supporters 330B maintain the attitude of the flying object 1 to the position when the supporters 330B touch the inner wall 110*a*, like the first embodiment.

Figure 10C:
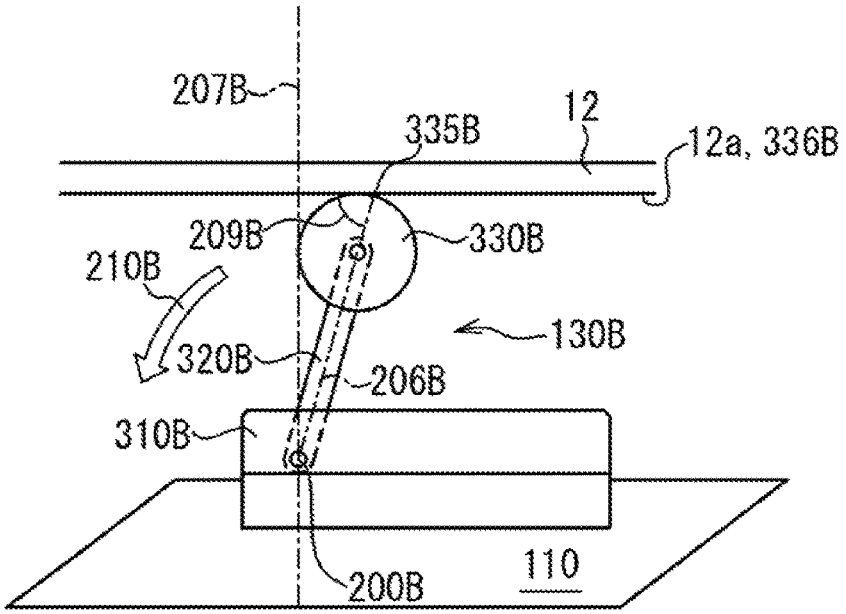
FIG. 10C is a diagram showing the arm shown in FIG. 10A.

The position of the arm 320B when the supporters 330B maintain the attitude of the flying object 1 will be described. As shown in FIG. 10C, when the supporters 330B maintain the attitude of the flying object 1, a line segment which links the contact point 335B of the supporter 330B and the dorsal fin 12 and the rotation axis 200B of the arm 320B is supposed to be a contact point line segment 206B. An angle between the contact point line segment 206B and the dorsal fin side surface 12*a* at the contact point 335B is supposed to be an arm angle 209B. Supposing that a contact point intersection line 336B is an intersection line of a tangential plane of the dorsal fin side surface 12*a* at the contact point 335B and a plane which is orthogonal to the rotation axis 200B and passes through the contact point 335B, the arm angle 209B can be said to be an angle between the contact point intersection line 336B and the contact point line segment 206B. The arm angle 209B shows an angle in the +z direction and may be smaller than 90 degrees. When the arm angle is smaller than 90 degrees, even if the biasing device 310B tries to rotate the arm 320B to the rotation direction 210B, the arm 320B cannot be rotated since the supporter 330B contacts the dorsal fin side surface 12*a*.

Also, a line which passes through the rotation axis 200B and is orthogonal to the dorsal fin side surface 12*a* at the contact point 335B is supposed to be a tangential plane normal line 207B. This tangential plane normal line 207B is orthogonal to the contact point intersection line 336B and passes through the rotation axis 200B. When the arms 320B maintain the attitude of the flying object 1, the end of the supporter 330B in the +z direction may come into contact with the tangential plane normal line 207B, when viewing to a direction parallel to the rotation axis 200B. In other words, when the arms 320B maintain the attitude of the flying object 1, the end of the supporter 330B in the +z direction may be in a position of the rotation axis 200B in the z direction, when viewing from the direction parallel to the rotation axis 200B. Moreover, in other words, when the arms 320B maintain the attitude of the flying object 1, the end of the supporter 330B in the +z direction may be in the position of the rotation axis 200B in an extension direction of the contact point intersection line 336B, when viewing from the direction parallel to the rotation axis 200B.

(Operation of Guide)

When the flying object 1 is launched, an operation that the guides 130B guide the flying object 1 is same as in the first embodiment. Specifically, when the flying object 1 is launched, the biasing device 310B applies the rotation force to the rotation direction 210B to the arm 320B. With the rotation force applied to the arm 320B, the rotation force to the rotation direction 210B is applied to the supporter 330B. However, the supporter 330B is obstructed by the dorsal fin side surface 12*a* of the flying object 1 so that it cannot be rotated. Therefore, by biasing the arm 320B to the rotation direction 210B, the biasing device 310B pushes the supporter 330B against the dorsal fin side surface 12*a* of the flying object 1.

When the flying object 1 is launched, the flying object 1 moves to the +z direction. Through the movement of the flying object 1, the end of the dorsal fin 12 in the −z direction reaches the position of the guide 130B. Therefore, the supporter 330B leaves the dorsal fin side surface 12*a*. As a result, the biasing device 310B can rotate the arm 320B to the rotation direction 210B. By the biasing device 310B rotating the arm 320B, the supporter 330B moves to the direction of the inner wall 110*a* and touches the inner wall 110*a*.

The flying object 1 further moves and the rear section 20 reaches the position of the guide 130B. The arm 320B rotates until touching the inner wall 110*a* when the supporter 330B leaves the dorsal fin side surface 12*a*. Thus, the guide 130B deviates from the region through which the flying object 1 passes. In other words, the guide 130B is evacuated into the neighborhood of the inner wall 110*a* not to contact the rear section 20. Therefore, the guide 130B does not obstruct the movement of the flying object 1 and the flying object 1 can be launched from the launch tube 100.

As mentioned above, since the launch tube 100 has the guide 130B, the attitude of the flying object 1 can be maintained when the flying object 1 is launched.

The operation of storing the flying object 1 in the launch tube 100 is the same as in the first embodiment.

Figure 11:
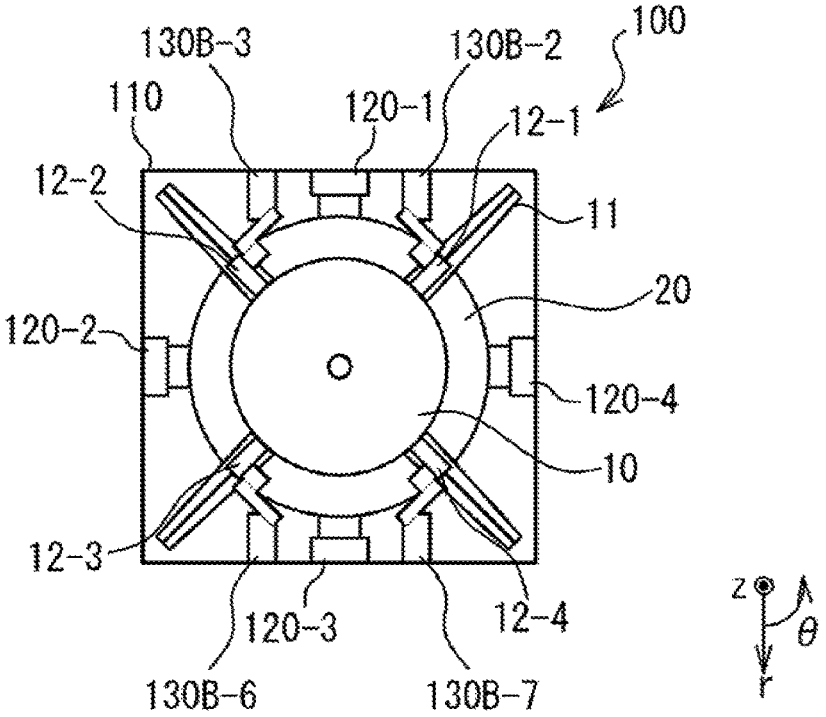
FIG. 11 is a diagram showing a modification example of the launch tube shown in FIG. 9A.

An example has been shown in which two guides 130B put the dorsal fin 12 therebetween to guide the flying object 1. However, the present invention is not limited to this. The guide 130B may have an optional configuration if the vibration, twist and so on of the flying object 1 can be restrained. For example, as shown in FIG. 11, the flying object 1 may be guided by providing two guides 130B for two opposite inner wall parts.

Third Embodiment

In the second embodiment, an example has been shown in which the direction of the rotation axis 200B is parallel to the dorsal fin side surface 12*a*. In this case, if the arm 320B is evacuated from the region through which the flying object 1 passes, there is a possibility that the arm 320B contacts the rail 120. An example will be described in which the direction of the rotation axis 200B is inclined with respect to the dorsal fin side surface 12*a*. The launch tube 100 according to the third embodiment is the same as in the second embodiment except for the guides 130C.

Figure 12A:
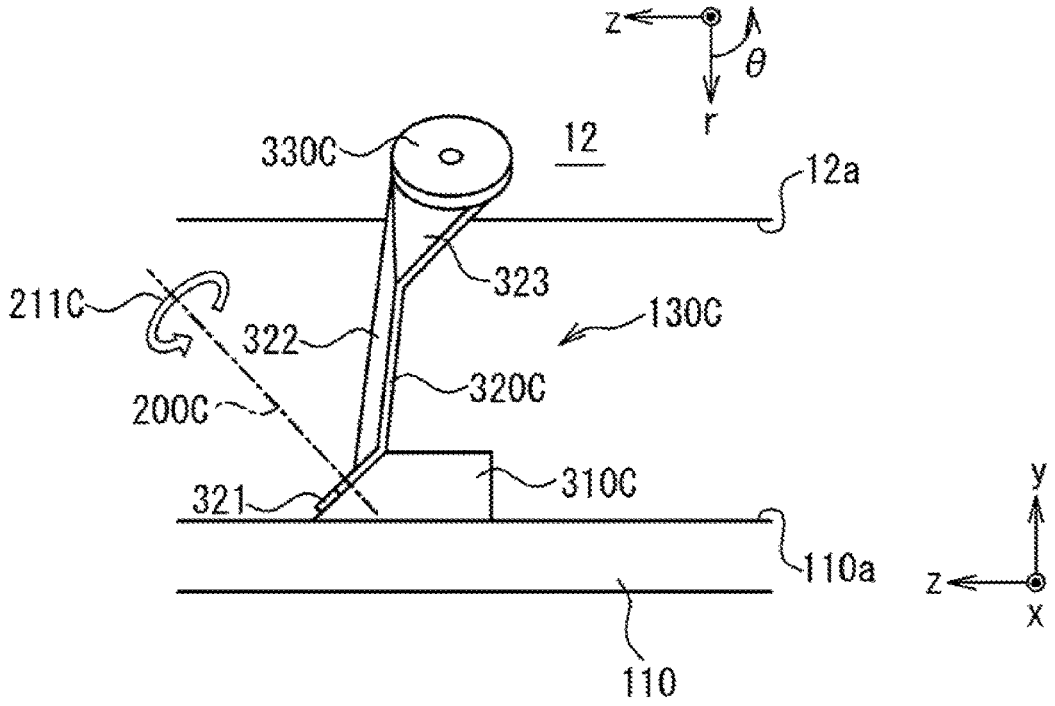
FIG. 12A is a schematic diagram showing the guide according to a third embodiment.
Figure 12B:
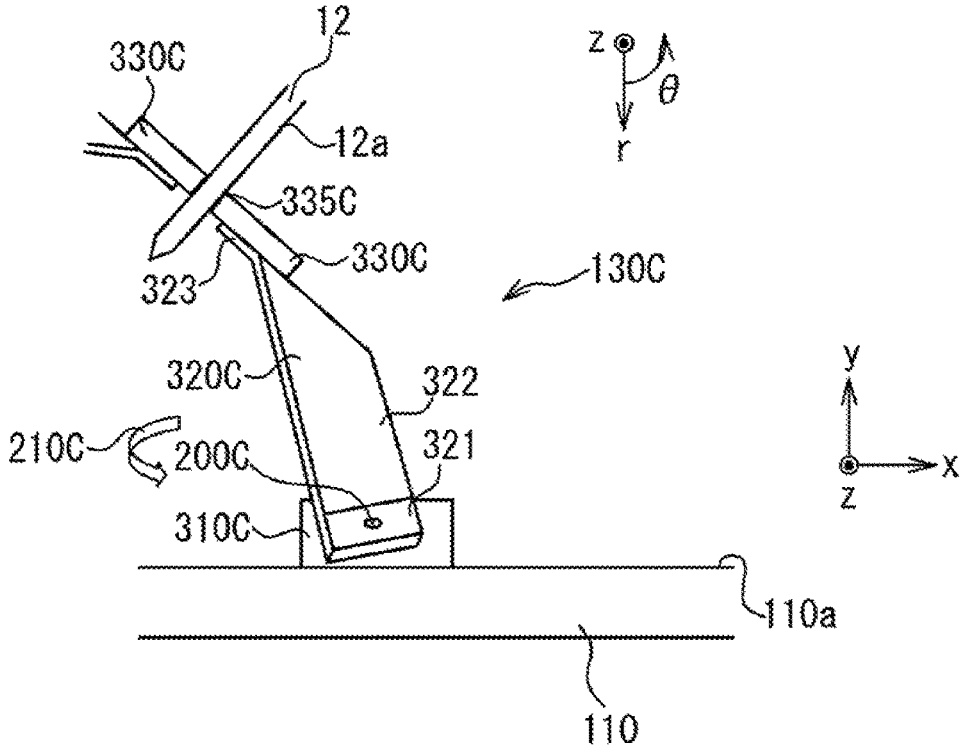
FIG. 12B is a diagram when viewing the guide shown in FIG. 12A to a direction opposite to the progressing direction of the flying object.

As shown in FIG. 12A and FIG. 12B, the two guides 130C hold the dorsal fin 12 therebetween, and guide the flying object 1, like the second embodiment. Therefore, the guide 130C is arranged to be able to contact the dorsal fin side surface 12*a*. The guide 130C has a biasing device 310C, an arm 320C and a supporter 330C. The supporter 330C touches the dorsal fin 12 and maintains the attitude of the front section 10, when the flying object 1 is launched.

The biasing device 310C is supported to the inner wall 110*a* of the tube 110. Also, the biasing device 310C supports the arm 320C to be possible to rotate. As shown in FIG. 12A, the direction of the rotation axis 200C of the arm 320C is parallel to the y-z plane and is inclined with respect to the Z axis. Therefore, the arm 320C can rotate from the state shown in FIG. 12A and FIG. 12B, to the rotation direction 210C. Since the arm 320C rotates to the rotation direction 210C, the supporter 330C is inclined for the inner wall 110*a* while rotating. In other words, while rotating to the rotation direction 210C around the rotation axis 200C, the arm 320C can be inclined to the +z direction for the inner wall 110*a*. Furthermore, in other words, the arm 320C can be inclined to a direction away from the dorsal fin 12. Therefore, the arm 320C can be inclined to the +z direction for the inner wall 110*a* from the state of FIG. 12A. For example, the arm 320C may be inclined until the arm 320C touches the inner wall 110*a*. Also, the biasing device 310C may apply the rotation force to the arm 320C so that the arm 320C is inclined to the progressing direction. This rotation force can be generated by using an optional method such as a spring force and a gas pressure force.

Here, the direction of the rotation axis 200C will be described in detail. The rotation axis 200C is parallel to the y-z plane and is inclined from the Z axis. In other words, the rotation axis 200C never becomes parallel to the Z axis. The normal line direction of the dorsal fin side surface 12*a* is parallel to the x-y plane and is inclined from the x axis. Therefore, the dorsal fin side surface 12*a* is parallel to a plane produced when the y-z plane is rotated around the Z axis. Therefore, the rotation axis 200C is inclined with respect to the dorsal fin side surface 12*a*. Moreover, an angle between the dorsal fin side surface 12*a* and the x axis may be larger than 30 degrees and smaller than 55 degrees. The angle between the dorsal fin side surface 12*a* and the x axis may be larger than 35 degrees and smaller than 50 degrees. Moreover, the angle may be larger than 40 degrees and smaller than 45 degrees. Because the rotation axis 200C is parallel to the y-z plane and never becomes parallel to the Z axis, a direction to orthogonal to the rotation axis 200C and the +z direction is the x direction. Therefore, an angle between a line orthogonal to the rotation axis 200C and the +z direction, and the dorsal fin side surface 12*a* may be larger than 30 degrees and smaller than 55 degrees. Also, this angle may be larger than 35 degrees and is smaller than 50 degrees. Moreover, this angle may be larger than 40 degrees and smaller than 45 degrees.

The arm 320C is provided to protrude from the inner wall 110*a* when the attitude of the flying object 1 is maintained. Also, the arm 320C extends to a direction inclined with respect to the dorsal fin side surface 12*a*. Moreover, the arm 320C supports the supporter 330C pivotally. The rotation region and shape of the arm 320C will be described later.

The supporter 330C is configured to be able to contact with the dorsal fin side surface 12*a* without obstructing the movement of the dorsal fin side surface 12*a* when the flying object 1 is launched, like the first embodiment. Therefore, the supporter 330C has, for example, a circular column shape and rotates according to the movement of the dorsal fin side surface 12*a*. The rotation axis of the supporter 330C may be the central axis of the circular column shape.

(Rotation Range of Arm)

The rotation range of the arm 320C will be described. The arm 320C is possible to rotate from the position when the supporters 330C maintain the attitude of the flying object 1 to the position when the supporter 330C touches the inner wall 110*a*, like the first embodiment. Also, the arm 320C may rotate from the position when the supporters 330C maintain the attitude of the flying object 1 to the position where the guide 130C deviates from the region through which the flying object 1 passes.

Figure 12C:
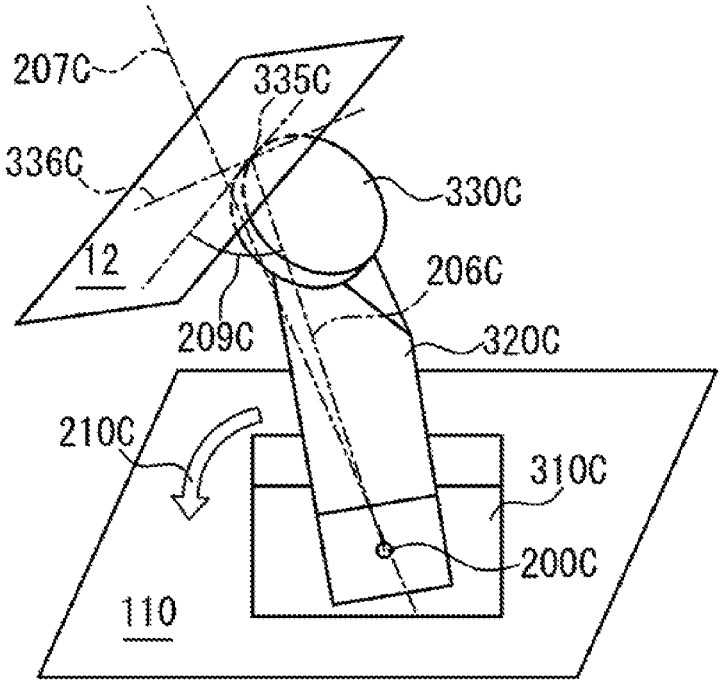
FIG. 12C is a diagram showing the arm shown in FIG. 12A.

The position of the arm 320C when the supporters 330C maintain the attitude of the flying object 1 will be described. As shown in FIG. 12C, a line segment which links the contact point 335C of the supporter 330C and the dorsal fin 12 and the rotation axis 200C of the arm 320C when the supporters 330C maintain the attitude of the flying object 1 is supposed to be a contact point line segment 206C. Also, the intersection line of the dorsal fin side surface 12*a* and a plane which is orthogonal to the rotation axis 200C and passes through the contact point 335C is supposed to be a contact point intersection line 336C. The contact point intersection line 336C is possible to say the intersection line of the tangential plane of the dorsal fin side surface 12*a* at the contact point 335C and a plane which is orthogonal to the rotation axis 200C and passes through the contact point 335C. An angle between the contact point intersection line 336C and the contact point line segment 206C is supposed to be an arm angle 209C. The arm angle 209C shows an angle in the +z direction and may be smaller than 90 degrees. When the arm angle is smaller than 90 degrees, the biasing device 310C cannot rotate the arm 320C since the supporter 330C contacts the dorsal fin side surface 12*a*, even if the biasing device 310C tries to rotate the arm 320C to the rotation direction 210C.

Also, a line which is orthogonal to the contact point intersection line 336C and passes through the rotation axis 200C is supposed to be the tangential plane normal line 207C. Viewing from a direction parallel to the rotation axis 200C, when the arms 320C maintain the attitude of the flying object 1, the end of the supporter 330C in the +z direction may come in contact with the tangential plane normal line 207C. In other words, viewing from the direction parallel to the rotation axis 200C, when the arms 320C maintain the attitude of the flying object 1, the end of the supporter 330C in the +z direction may be in a position of the rotation axis 200C in the extending direction of the contact point intersection line 336C.

(Operation of Guide)

Figure 13A:
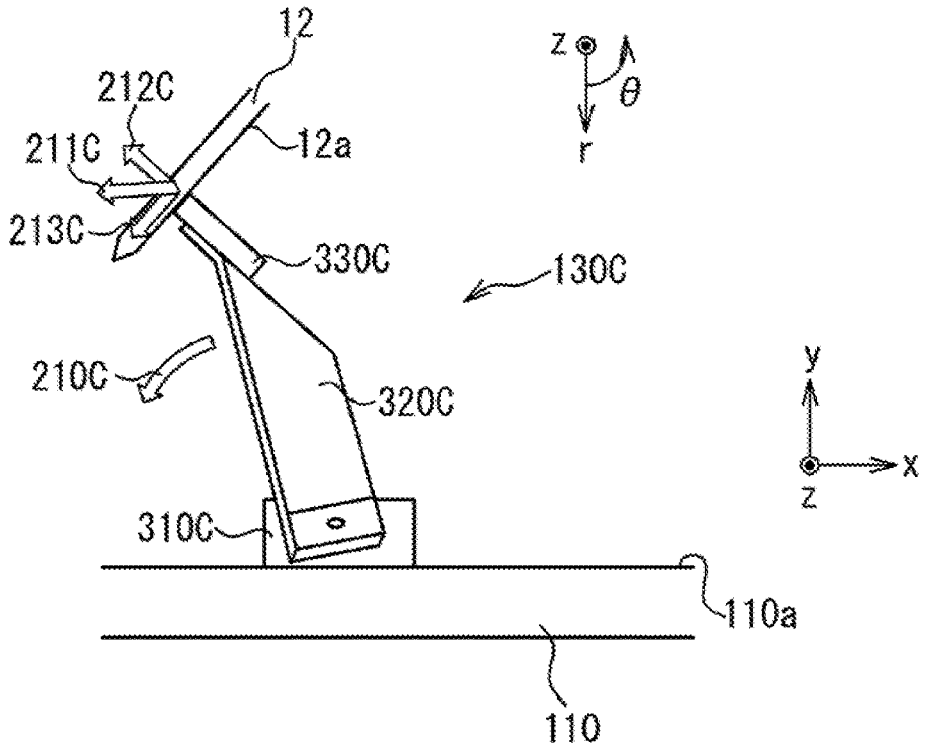
FIG. 13A is a diagram showing a movement of the guide shown in FIG. 12A.

Next, an operation in which the guides 130C guide the flying object 1 when the flying object 1 is launched will be described. As shown in FIG. 13A, when the flying object 1 is launched, the biasing device 310C applies the rotation force to the rotation direction 210C to the arm 320C. For example, the biasing device 310C applies the rotation force to the arm 320C from the time when the flying object 1 has been stored in the launch tube 100 to the time when the flying object 1 is launched. In more detail, the biasing device 310C applies the rotation force to the arm 320C until the flying object 1 leaves the launch tube 100. The rotation force in the rotation direction 210C is applied to the supporter 330C by the rotation force applied to the arm 320C. However, the supporter 330C cannot rotate since being obstructed by the dorsal fin side surface 12*a* of the flying object 1. Therefore, the pushing force 211C is applied to the dorsal fin side surface 12*a* of the flying object 1. The pushing force 211C can be shown by the resultant force of a parallel component 213C parallel to the dorsal fin side surface 12*a* and an orthogonal component 212C. In other words, the biasing device 310C pushes the supporter 330C against the dorsal fin side surface 12*a* of the flying object 1 with the force of the orthogonal component 212C by biasing the arm 320C to the rotation direction 210C.

Figure 13B:
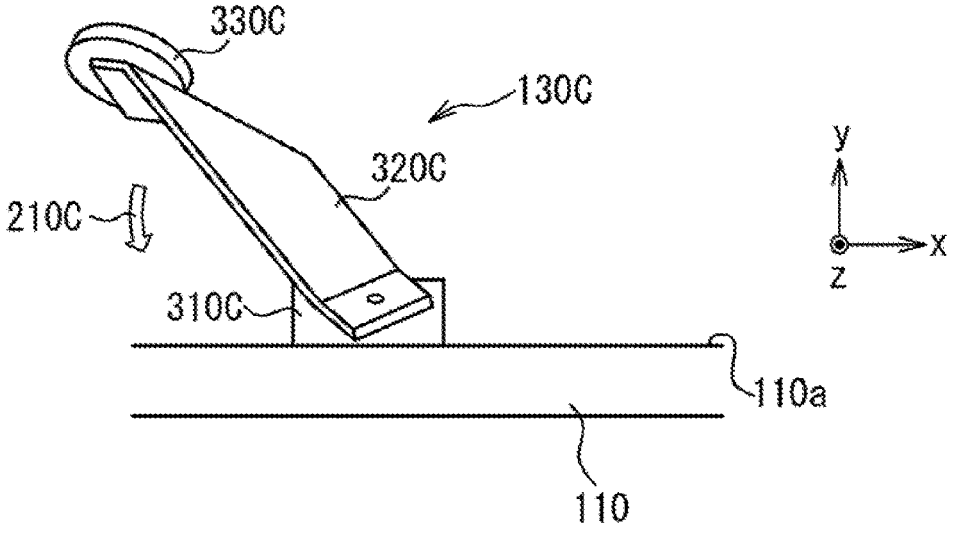
FIG. 13B is a diagram showing the movement of the guide shown in FIG. 12A.
Figure 13C:
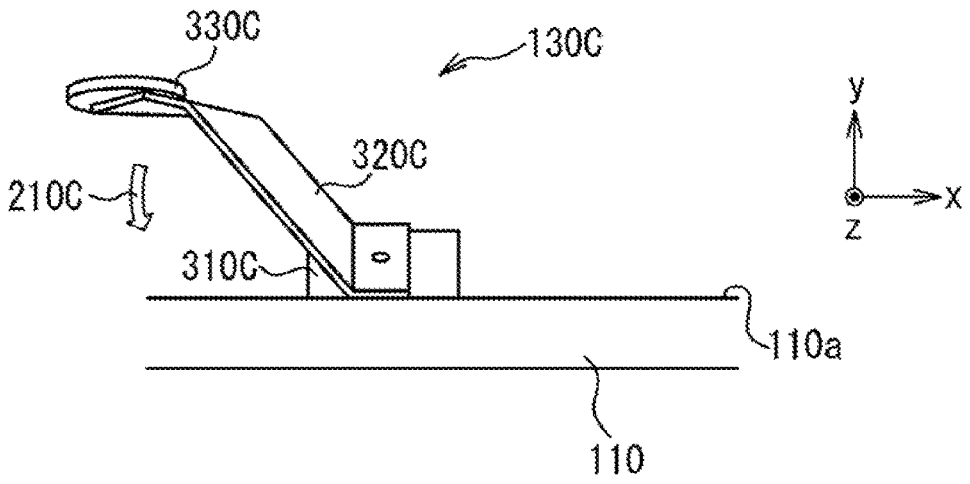
FIG. 13C is a diagram showing the movement of the guide shown in FIG. 12A.
Figure 13D:
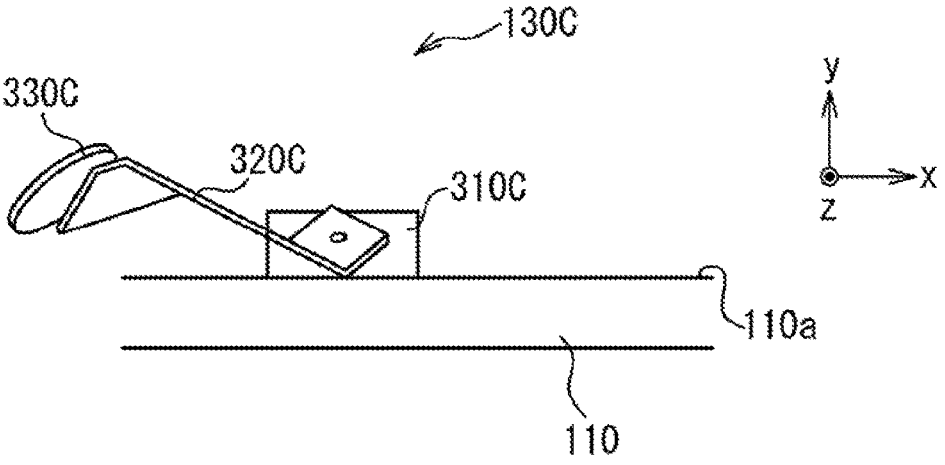
FIG. 13D is a diagram showing the movement of the guide shown in FIG. 12A.

When the flying object 1 is launched, the flying object 1 moves to the +z direction. The end of the dorsal fin 12 in the −x direction reaches the position of the guide 130C during the movement of the flying object 1. Therefore, the supporter 330C leaves the dorsal fin side surface 12*a*. As shown in FIG. 13B, as a result, the biasing device 310C rotates the arm 320C to the rotation direction 210C. As shown in FIG. 13C, through the rotation of the arm 320C by the biasing device 310C, the supporter 330C moves to the direction of the inner wall 110*a* while rotating. In other words, the supporter 330C moves to the direction of the tip of dorsal fin 12 when viewing from the z direction. In other words, the supporter 330C moves to the direction of the corner of the tube 110. In other words, the supporter 330C moves to a direction of boundary of the neighboring inner wall 110*a* of the tube 110. Moreover, as shown in FIG. 13D, the biasing device 310C rotates the arm 320C to a predetermined position. The biasing device 310C may rotate the supporter 330C until the supporter 330C touches the inner wall 110*a*. Also, the biasing device 310C may rotate the supporter 330C from the region through which the flying object 1 passes, to the position where the guide 130C comes off.

The flying object 1 further moves and the rear section 20 reaches the position of the guide 130C. When the guide 130C leaves the dorsal fin side surface 12*a*, the biasing device 310C rotates the arm 320C. Therefore, a distance from the line, which passes through the center of the flying object 1 and is parallel to the z direction, to the guide 130, namely, a distance from the center of the flying object 1 in the r direction to the guide 130 becomes long. In other words, because the shortest distance from the line which passes through the central axis of the launch tube 100 and is parallel to the z direction, to the guide 130C becomes long, the guide 130C deviates from the region through which the flying object 1 passes. As a result, the guide 130C evacuates into the neighborhood of the inner wall 110*a* so that the rear section 20 does not touch the guide 130C. In other words, the flying object 1 can be launched from the launch tube 100 without the guide 130C obstructing the movement of the flying object 1.

As mentioned above, the launch tube 100 can maintain the attitude of the flying object 1 when the flying object 1 is launched, since the launch tube 100 has the guide 130C.

Next, the operation of storing the flying object 1 in the launch tube 100 can be configured like the first embodiment.

(Shape of Arm)

Figure 14:
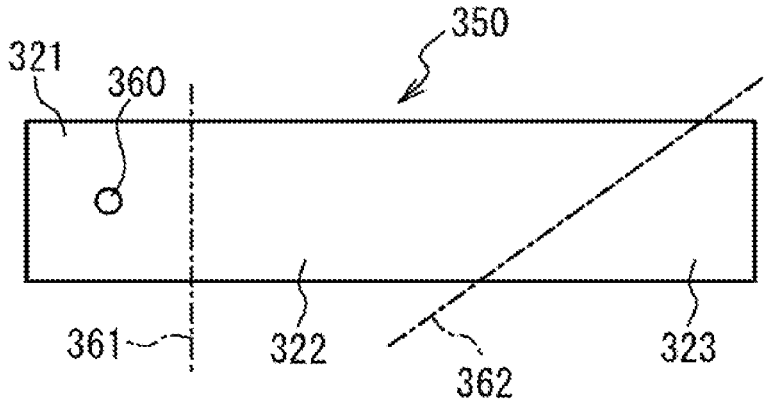
FIG. 14 is a diagram showing a shape of the arm shown in FIG. 12A.

Here, an example of shape of the arm 320C will be described. As shown in FIG. 14, the arm 320C is formed by bending a rectangular flat board 350 on a first folding line 361 and a second folding line 362. The first folding line 361 is a line which is orthogonal to the longitudinal side of the board 350 and crosses the board 350. The second folding line 362 is a line which is inclined with respect to the longitudinal side of the board 350 and crosses the board 350. In the board 350, a flat board section outside the first folding line 361 forms a leg section 321 with which the biasing device 310C is connected. A flat board section outside the second folding line 362 forms a supporter holding section 323 with which the supporter 330C is connected. A section between the first folding line 361 and the second folding line 362 forms a central section 322. Also, an axis hole 360 to configure the rotation axis 200C is provided for the leg section 321.

Figure 15A:
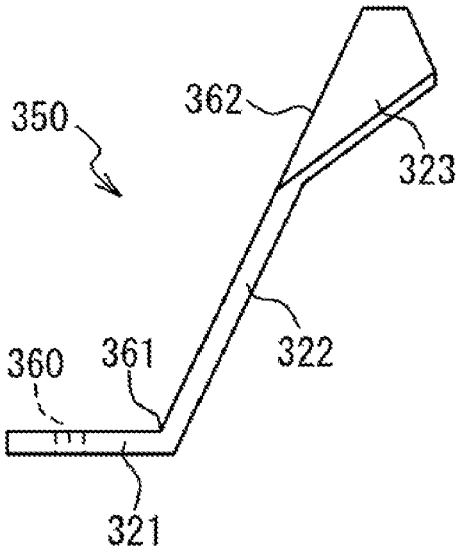
FIG. 15A is a front view of the arm shown in FIG. 12A.
Figure 15B:
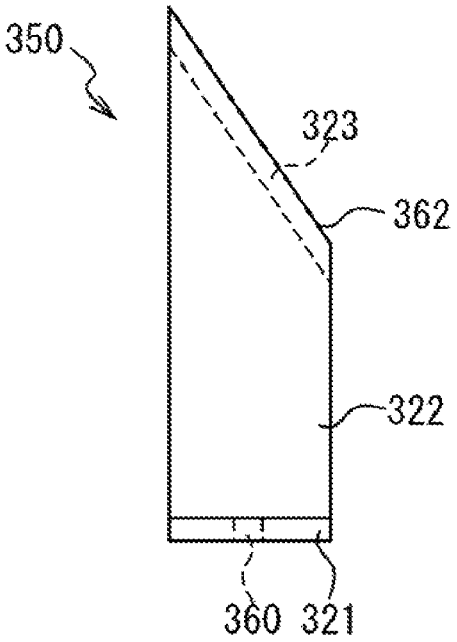
FIG. 15B is a left side view of the arm shown in FIG. 12A.

As shown in FIG. 15A, the board 350 is bent in the first folding line 361 so that an angle between the leg section 321 and the central section 322 is larger than 90 degrees and is smaller than 180 degrees. The angle between the leg section 321 and the central section 322 may be 120 degrees. As shown in FIG. 15A and FIG. 15B, the board 350 is bent at the second folding line 362 so that an angle between the central section 322 and the supporter holding section 323 becomes 90 degrees. Also, as shown in FIG. 15A and FIG. 15B, the board 350 is bent in the first folding line 361 to a direction opposite to the bent direction at the second folding line 362.

When the flying object 1 is launched, the attitude of the flying object 1 can be maintained by using the arm 320C of such a shape.

An example has been shown in which the two guides 130C put the dorsal fin 12 therebetween to guide the flying object 1. However, the present invention is not limited to this. The guides 130C are enough to restrain the vibration, twist and so on of the flying object 1, like the second embodiment. An optional configuration can be selected for the guide 130C.

Figure 16A:
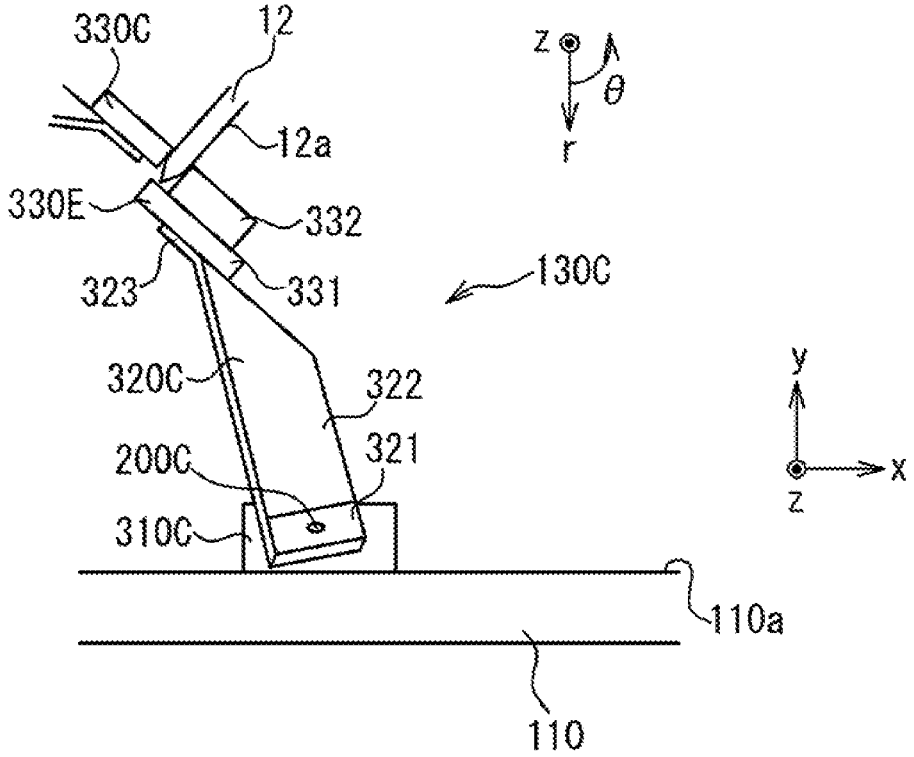
FIG. 16A is a diagram showing a modification example of the guide shown in FIG. 12A.
Figure 16B:
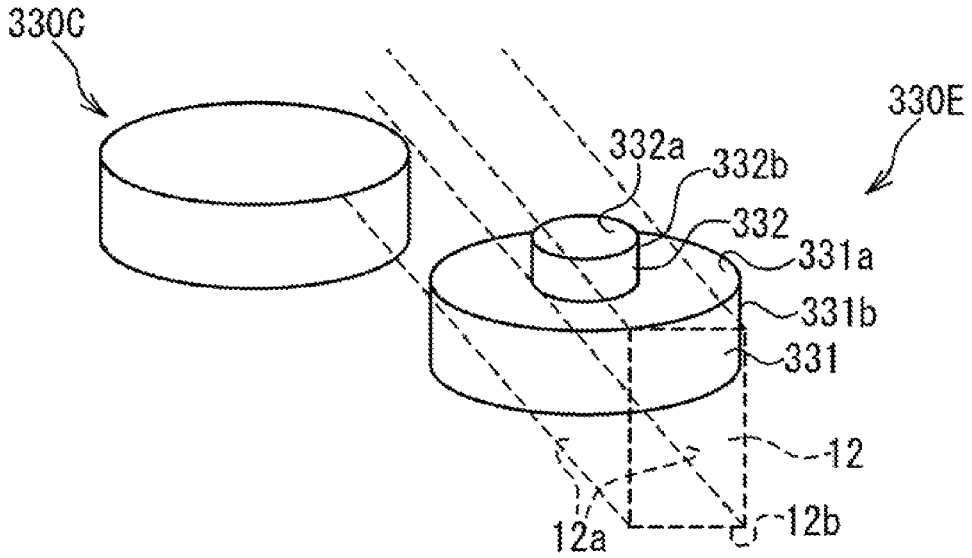
FIG. 16B is a diagram showing a supporter shown in FIG. 16A.

Also, the shape of the supporter 330C is not limited to this. As shown in FIG. 16A and FIG. 16B, the supporter 330E (the first supporter 331, the second supporter 332) may have two circular column different in a diameter. Here, the first supporter 331 has an upper surface 331*a* orthogonal to the central axis of the circular column and a side surface of the circular column 331*b*. Also, the second supporter 332 has an upper surface 332*a* orthogonal to the central axis of the circular column and a side surface 332*b* of a circular column.

In this case, the diameter of the first supporter 331 is larger than the diameter of the second supporter 332. Also, the central axis of the first supporter 331 may be coincident with that of the second supporter 332. The side surface 332*b* of the second supporter 332 contacts the dorsal fin side surface 12*a*, like the supporter 330C. Also, that dorsal fin 12 is sandwiched by the supporter 330C and the second supporter 332, and the attitude of the flying object 1 is maintained in the direction orthogonal to the dorsal fin side surface 12*a*. Moreover, the upper surface 331*a* of the first supporter 331 contacts the end surface 12*b* of the dorsal fin of dorsal fin 12. Thus, the direction of the tip of the dorsal fin 12 when viewing from the z direction, the attitude of the flying object 1 is maintained. As a result, the guide 130C guides the two dorsal fins 12 arranged on the diagonal lines of the launch tube 100 to maintain the attitude of the flying object 1. In this way, the number of guides 130C may be reduced depending on the shape of the supporter 330C. The end surface 12*b* of the dorsal fin points the surface of the end in the radius direction of the flying object 1, i.e. in the r direction. Also, a similar effect can be obtained by applying the shape of the supporter 330E to the second embodiment.

Fourth Embodiment

Figure 17A:
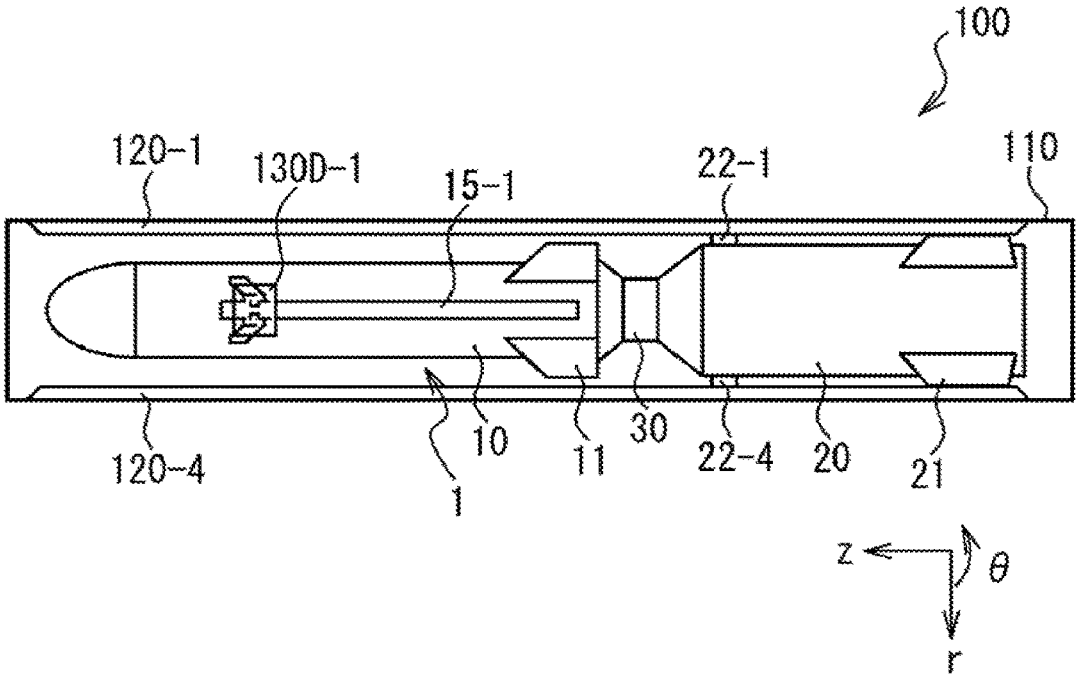
FIG. 17A is a schematic diagram showing the launch tube according to a fourth embodiment.

When the flying object 1 has a protruding section 15 extending to the z direction, as shown in FIG. 17A, the guide 130D may contact the protruding section 15 to maintain the attitude of the flying object 1. As the protruding section 15, a tunnel cover is exemplified which is provided to protrude from the front section side surface 10*a* of the front section 10 in order to store a wiring line and so on.

Figure 17B:
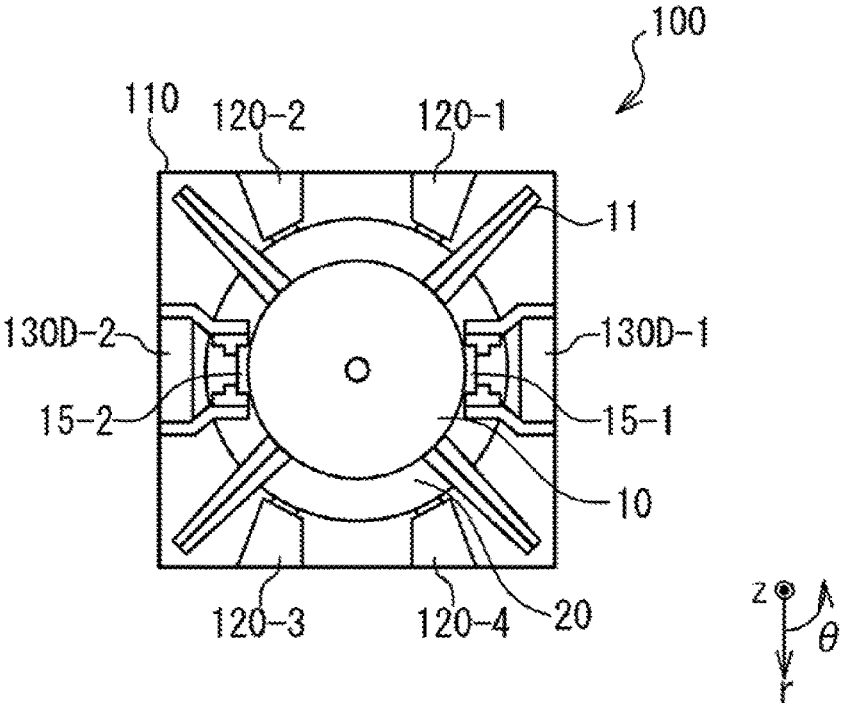
FIG. 17B is a diagram when viewing the launch tube shown in FIG. 17A to a direction opposite to the progressing direction of the flying object.

As shown in FIG. 17A and FIG. 17B, the flying object 1 has a plurality of protruding sections 15 (the first protruding section 15-1, the second protruding section 15-2). The first protruding section 15-1 and the second protruding section 15-2 are provided to oppose to each other so as to sandwich the front section 10. In other words, the first protruding section 15-1 and the second protruding section 15-2 are arranged to be shifted by 180 degrees in a θ direction.

The guide 130D is arranged to be able to contact the protruding section 15. Specifically, the first guide 130D-1 is arranged to be able to contact the first protruding section 15-1. The second guide 130D-2 is arranged to be able to contact the second protruding section 15-2. Therefore, the first guide 130D-1 and the second guide 130D-2 are provided to oppose to each other so as to sandwich the front section 10. In other words, the first guide 130D-1 and the second guide 130D-2 are arranged to be shifted by 180 degrees in the θ direction. Therefore, the first guide 130D-1 and the second guide 130D-2 may be respectively arranged on the parts of the inner wall 110*a* of the tube 110 opposing to each other.

Also, the two guides 130D put the front section 10 of the flying object 1 therebetween, to restrain the vibration, twist and so on of the front section 10, and to maintain the attitude of the front section 10. Therefore, each guide 130D is arranged in the same position in the z direction, like the first embodiment. Moreover, the position of each guide 130D in the z direction may be in the progressing direction from the center of gravity of the flying object 1. The position of each guide 130D in the z direction may be in the progressing direction more than the position of the center of gravity of the front section 10.

Also, the diameter of the front section 10 is smaller than that of the rear section 20. Therefore, a distance from the center of the flying object 1 to the rail 120 in the r direction may be longer than the distance from the center of the flying object 1 to the guide 130D. In other words, when viewing to a direction opposite to the z direction, the shortest distance to the rail 120 from the center of the tube 110 may be longer than that to the guide 130D from the center of the tube 110.

The other configuration is same as the first embodiment.

Figure 18A:
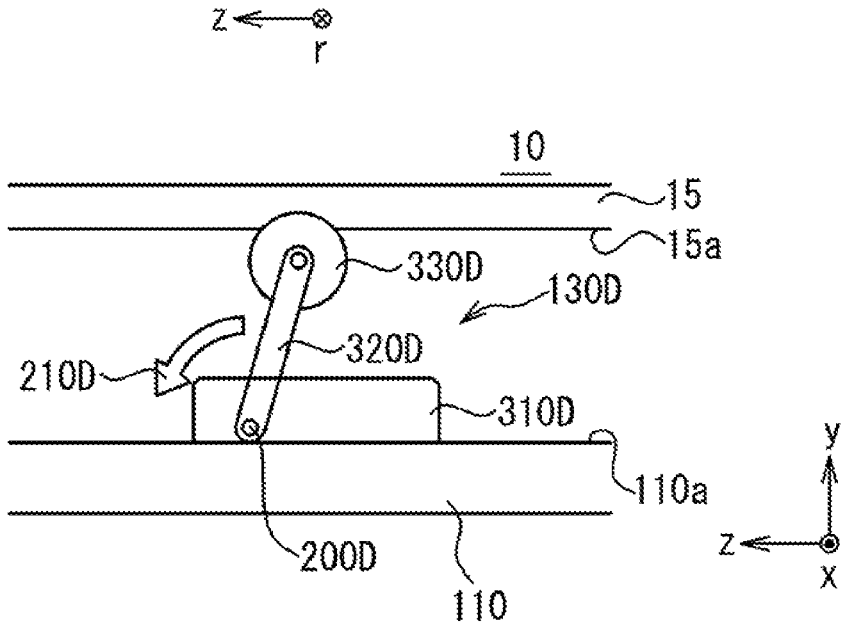
FIG. 18A is a schematic diagram showing the guide shown in FIG. 17A.
Figure 18B:
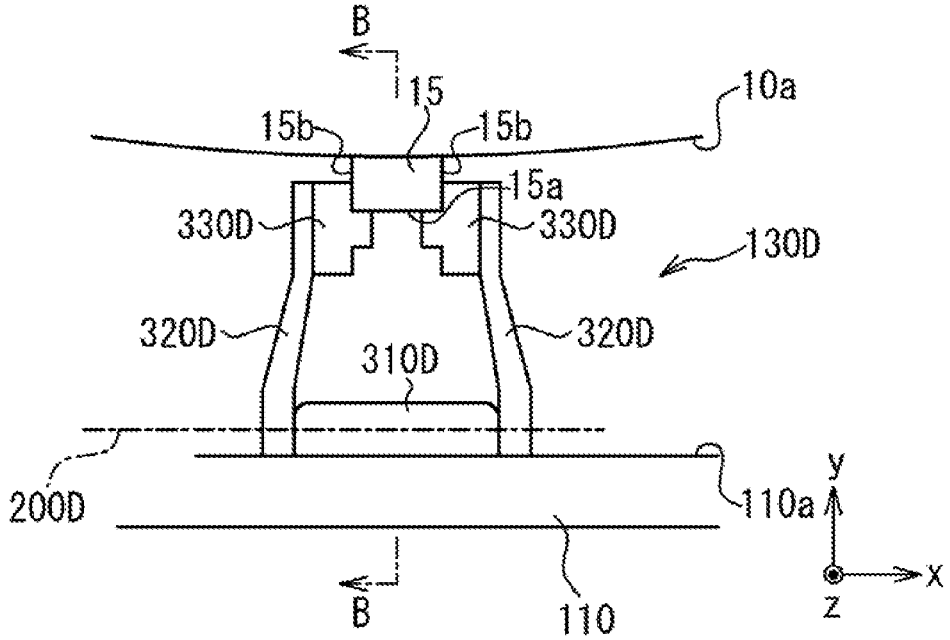
FIG. 18B is a diagram when viewing the guide shown in FIG. 18A to a direction opposite to the progressing direction of the flying object.

The configuration of the guide 130D will be described in detail. As shown in FIG. 18A, the guide 130D has a biasing device 310D, two arms 320D and two supporters 330D. When the flying object 1 is launched, the supporters 330D contact the protruding section 15 and maintain the attitude of the front section 10. Specifically, as shown in FIG. 18B, when the flying object 1 has been stored in the launch tube 100, the supporters 330D contact the protruding section end surface 15*a* of the protruding section 15 and the protruding section side surface 15*b* of the protruding section 15. Here, the protruding section end surface 15*a* points to the end surface of the protruding section 15 in the −y direction. In other words, the protruding section end surface 15*a* points to the end surface protruding from the front section side surface 10*a*. The protruding section side surfaces 15*b* point to a side surface of the protruding section 15 in the +x direction and a side surface of the protruding section 15 in the −x direction. In other words, the protruding section side surfaces 15*b* point to the side surfaces of the protruding section 15 which are parallel to the z direction.

Each section of the guide 130D will be described in detail. The biasing device 310D is supported by the inner wall 110*a* of the tube 110. Also, the biasing device 310D supports the arms 320D to be rotatable. As shown in FIG. 18B, the rotation axis 200D of the arm 320D may be orthogonal to the z direction and parallel to the inner wall 110*a*. Also, the rotation axis 200D of the arm 320D may be parallel to the protruding section end surface 15*a*. In other words, the rotation axis 200D of the arm 320D may be parallel to a tangential plane of the protruding section end surface 15*a* at the contact point 335D of the protruding section end surface 15*a* and the supporter 330D. Therefore, the arm 320D can be inclined to the +z direction for the inner wall 110*a* from the state shown in FIG. 18A. In other words, the arm 320D can be inclined to a direction to which the arm 320D leaves the protruding section end surface 15*a*. Also, the biasing device 310D may apply the rotation force to the arms 320D so that the arms 320D are inclined to the +z direction. This rotation force can be generated by an optional method using a spring force and a gas pressure force.

The arms 320D are provided to protrude from the inner wall 110*a* when the attitude of the flying object 1 is to be maintained. Also, when viewing to a direction opposite to the z direction, the arm 320D extends to the direction orthogonal to the protruding section end surface 15*a*. In other words, the arm 320D extends to a direction orthogonal to the tangential plane of the protruding section end surface 15*a* at the contact point 335D. Moreover, the arm 320D supports the supporter 330D to be rotatable. The rotation range of the arm 320D will be described later.

Figure 18C:
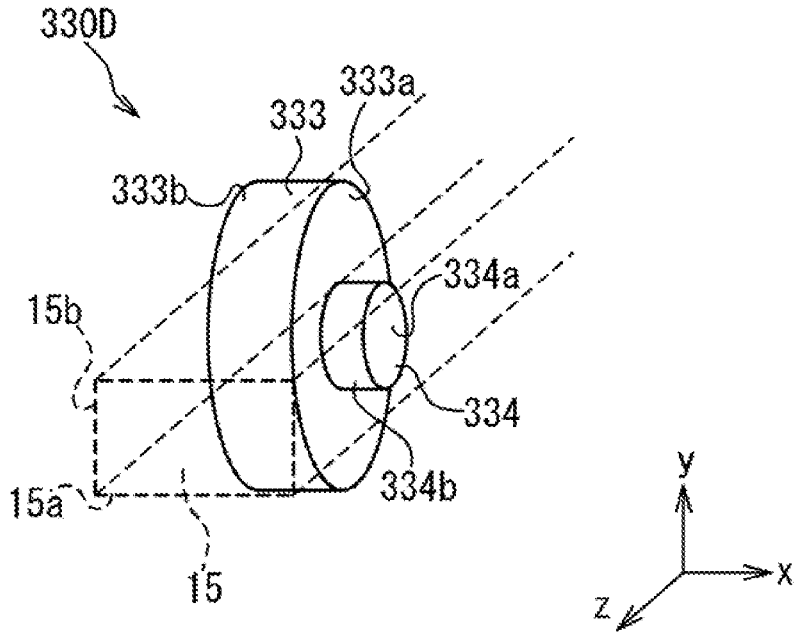
FIG. 18C is a diagram showing the supporter shown in FIG. 18A.

The supporter 330D is configured to be able to contact the protruding section end surface 15*a* without obstructing the movement of the protruding section end surface 15*a*, when the flying object 1 is launched. Therefore, as shown in FIG. 18C, the supporter 330D has two circular columns (the first supporter 333, the second supporter 334), and rotates according to the movement of the protruding section end surface 15*a*. Here, the first supporter 333 has an upper surface 333*a* orthogonal to the central axis of the circular column and a side surface 333*b* of the circular column. Also, the second supporter 334 has an upper surface 334*a* orthogonal to the central axis of the circular column and a side surface 334*b* of the circular column.

The diameter of the first supporter 333 is larger than that of the second supporter 334. Also, the central axis of the first supporter 333 may be coincident with that of the second supporter 334. The supporter 330D rotates around this central axis. Also, the upper surface 333*a* of the first supporter 333 contacts the protruding section side surface 15*b*. Here, the protruding section side surfaces 15*b* on both sides of the protruding section 15 are put between the two supporters 330D as shown in FIG. 18B. Therefore, the attitude of the flying object 1 is maintained in a direction orthogonal to the protruding section side surfaces 15*b*, i.e. the x direction. Also, the side surface 334*b* of the second supporter 334 contacts the protruding section end surface 15*a*. As mentioned above, the flying object 1 is put between the first guide 130D-1 and the second guide 130D-2 in a direction orthogonal to the protruding section end surface 15*a*, i.e. the y direction. Therefore, the attitude of the flying object 1 is maintained in the y direction. In this way, since the launch tube 100 has the two guides 130D which touch the protruding section 15, the attitude of the flying object 1 can be maintained.

(Rotation Range of Arm)

The rotation range of the arm 320D will be described. Like the first embodiment, the arm 320D can rotate from the position when the supporters 330D maintain the attitude of the flying object 1 to the position when the supporters 330D touch the inner wall 110*a*.

Figure 18D:
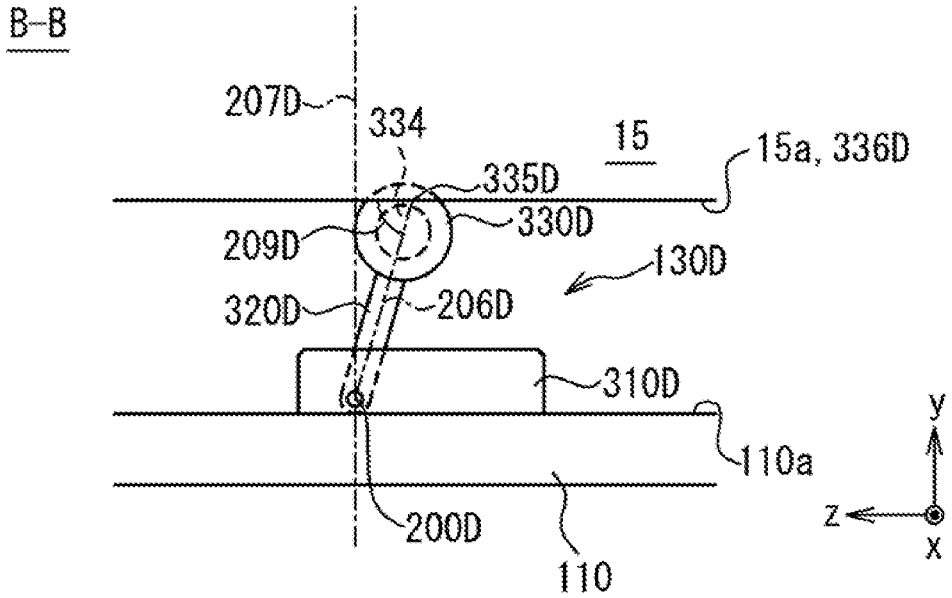
FIG. 18D is a diagram showing the arm shown in FIG. 18A.

The position of the arm 320D when the supporters 330D maintain the attitude of the flying object 1 will be described. As shown in FIG. 18D, when the supporters 330D maintain the attitude of the flying object 1, a line segment which links the contact point 335D of the second supporter 334 of the supporters 330D and the protruding section end surface 15*a* and the rotation axis 200D of the arms 320D is supposed to be a contact point line segment 206D. An angle between the contact point line segment 206D and the protruding section end surface 15*a* at the contact point 335D is supposed to be an arm angle 209D. An intersection line of a tangential plane of the protruding section end surface 15*a* at the contact point 335D and a plane which is orthogonal to the rotation axis 200D and passes through the contact point 335D is supposed to be a contact point intersection line 336D. At this time, the arm angle 209D is the angle between the contact point intersection line 336D and the contact point line segment 206D. The arm angle 209D shows an angle in the +z direction and may be smaller than 90 degrees. When the arm angle is smaller than 90 degrees, the biasing device 310D cannot rotate the arm 320D since the supporters 330D contact the protruding section end surface 15*a*, even if the biasing device 310D tries to rotate the arms 320D to the rotation directions 210D.

Also, a line which passes through the rotation axis 200D and is orthogonal to the protruding section end surface 15*a* at the contact point 335D is supposed to be a tangential plane normal line 207D. The tangential plane normal line 207D can be said to be a line which is orthogonal to the contact point intersection line 336D and passes through the rotation axis 200D. When the guides 130D maintain the attitude of the flying object 1, the ends of the supporters 330D in the +z direction may come in contact with the tangential plane normal line 207D, when viewing to a direction opposite to the direction parallel to the rotation axis 200D. In other words, when the arms 320D maintain the attitude of the flying object 1, the position of the ends of the supporters 330D in the +z direction may be the position of the rotation axis 200D in the z direction, when viewing to a direction opposite to the direction parallel to the rotation axis 200D. Moreover, in other words, when the arms 320D maintain the attitude of the flying object 1, the position of the ends of the supporters 330D in the +z direction may be the position of the rotation axis 200D in an extension direction of the contact point intersection line 336D, when viewing to a direction opposite to the direction parallel to the rotation axis 200D.

(Movement of Guide)

The movement of the guide 130D which guides the flying object 1 when the flying object 1 is launched is same as the first embodiment. Specifically, when the flying object 1 is launched, the biasing device 310D applies the rotation force to the rotation direction 210D to the arms 320D. By the rotation force applied to the arms 320D, the rotation force to the rotation directions 210D is applied to the supporters 330D. However, the supporters 330D cannot rotate since it is obstructed by the protruding section end surface 15*a* of the flying object 1. Therefore, the biasing device 310D biases the arms 320D to the rotation direction 210D so that the supporters 330D are pushed against the protruding section end surface 15*a* of the flying object 1.

When the flying object 1 is launched, the flying object 1 moves to the +z direction. Thus, the flying object 1 moves so that the end of the protruding section 15 in the −z direction reaches the position of the guide 130D. Therefore, the supporters 330D leave the protruding section end surface 15*a*. As a result, the biasing device 310D can rotate the arms 320D to the rotation direction 210D. Since the biasing device 310D rotates the arms 320D, the supporters 330D move toward the inner wall 110*a* and touch the inner wall 110*a*.

The flying object 1 further moves and the rear section 20 reaches the position of the guide 130D. The arms 320D rotate until they contacts the inner wall 110*a* when the supporters 330D leave the protruding section end surface 15*a*. Thus, the guide 130D deviates the region through which the flying object 1 passes. In other words, the guide 130D evacuates into the neighborhood of the inner wall 110*a* and the rear section 20 does not touch the guide 130D. Therefore, the flying object 1 can be launched from the launch tube 100 without obstructing the movement of the flying object 1 by the guides 130D.

As described above, when the flying object 1 is launched, the attitude of the flying object 1 can be maintained since the launch tube 100 has the guides 130D.

The operation of storing the flying object 1 in the launch tube 100 can be carried out like the first embodiment.

MODIFICATION EXAMPLE

Modification examples will be described from here based on the first embodiment. The modification examples can be applied to the second to fourth embodiments.

Figure 19:
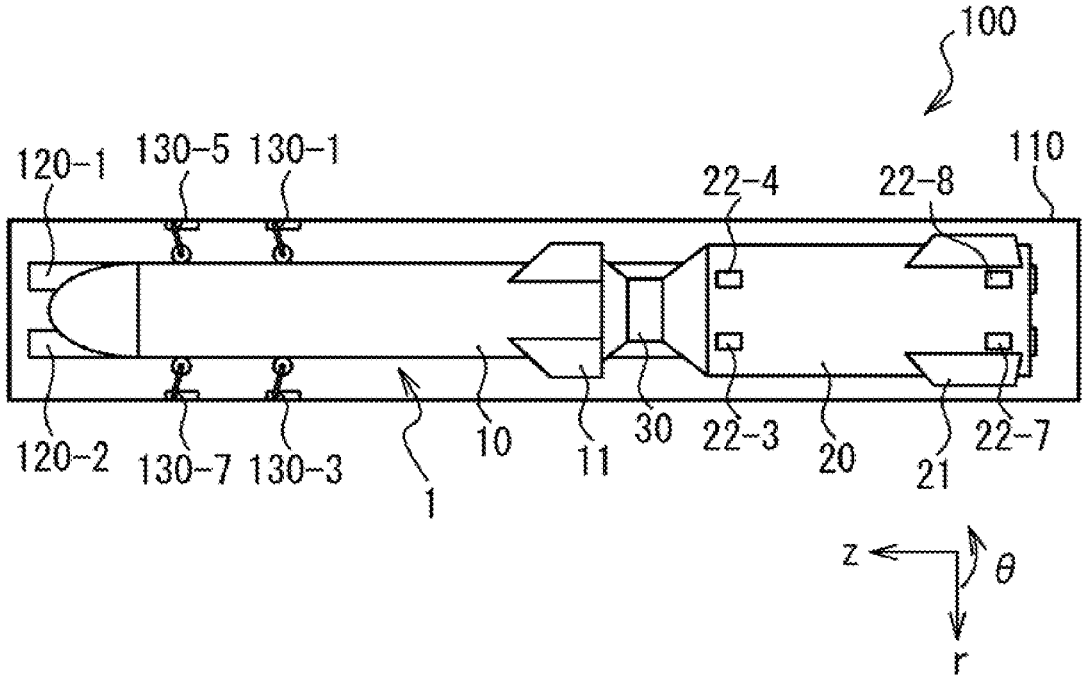
FIG. 19 is a diagram showing a modification example of the arrangement of the guide.

In the above embodiments, an example has been shown in which the guide 130 is arranged in one position in the z direction. However, the present invention is not limited to this. The flying object 1 moves to the +z direction when being launched. Therefore, as shown in FIG. 19, the guide 130 may be arranged in a plurality of positions in the z direction. When the guides 130 are arranged in the plurality of positions, the attitude of the flying object 1 can continue to be maintained even if the flying object 1 moves to the +z direction. The position of each guide 130 may be provided into the +z direction from the center of gravity of the flying object 1. The position of each guide 130 in the z direction may be provided in the center of gravity position of the front section 10. Also, the position of each guide 130 in the z direction may be provided into the +z direction more than the center of gravity position of the front section 10. Moreover, each guide 130 is enough to maintain the attitude of the flying object 1, and may be arranged in an optional position.

Figure 20:
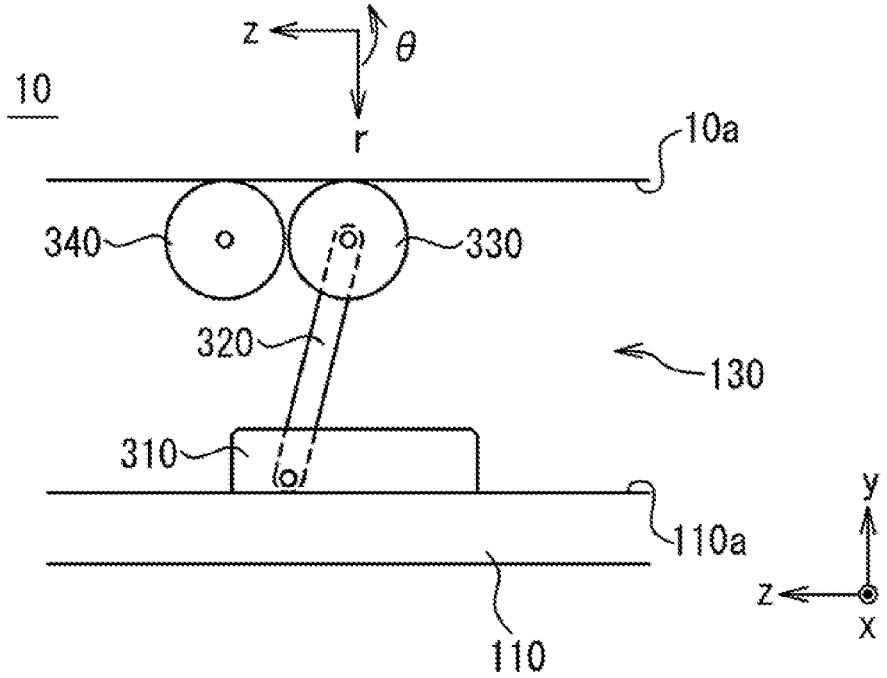
FIG. 20 is a diagram showing a modification example of shape of the supporter.

Also, an example has been shown in which the supporter 330 has the circular column shape. However, the present invention is not limited to this. It is enough that the supporters 330 can maintain the attitude of the flying object 1 without obstructing the movement of the flying object 1. An optional shape can be selected. For example, the surface of the supporter 330, especially, the contact section of the flying object 1 such as the front section side surface 10*a* may have a high lubrication. In this case, while the front section side surface 10*a*, the dorsal fin side surface 12*a*, the protruding section end surface 15*a* and so on slide on the surface of the supporter 330, the flying object 1 moves to the progressing direction. Moreover, as shown in FIG. 20, the guide 130 may have an auxiliary supporter 340. The auxiliary supporter 340 is arranged in a direction to which the supporter 330 is inclined, from the position of the supporter 330. Also, a plurality of auxiliary supporters 340 may be provided. Also, in the second to fourth embodiments, the supporter 330 may be added in the direction parallel to the rotation axis 200 of the supporter 330, like the first embodiment.

Figure 21:
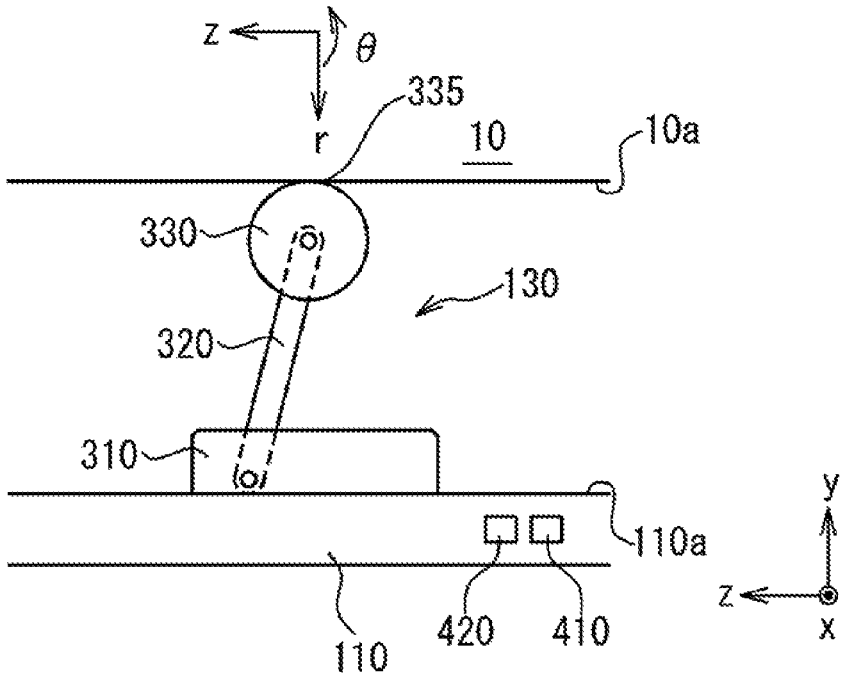
FIG. 21 is a diagram showing a modification example of the guide.

In the above embodiments, an example has been shown in which the arm 320 is inclined to the +z direction to evacuate from the movement region of the flying object 1. However, the present invention is not limited to this. The arm 320 may be inclined to the −z direction. In this case, the arm angle 209 shows an angle between the contact point line segment 206 in the direction of inclination of the arm 320, i.e. the −z direction and the contact point intersection line 336. Also, the end of supporter 330 in a direction of inclination of the supporter 330, i.e. the −z direction may come in contact with the tangential plane normal line 207, when the supporters 330 maintain the attitude of the flying object 1. In other words, when the supporters 330 maintain the attitude of the flying object 1, the position of the end of the supporter 330 in the inclination direction may be the position of the rotation axis 200 in a direction of the contact point intersection line 336, i.e. the z direction. Also, when the flying object 1 is launched, the arm 320 may be inclined based on the position of the flying object 1. In this case, as shown in FIG. 21, the launch tube 100 may have a detection sensor 410 which detects the position of the flying object 1 and a control device 420 which outputs a command to the biasing device 310. In this case, the detection sensor 410 detects the position of the flying object 1. The control device 420 determines whether or not the flying object 1 has reached a predetermined position, based on the detection result by the detection sensor 410. When the control device 420 determines that the flying object 1 to have reached the predetermined position, the control device 420 transmits a signal to the biasing device 310 to rotate the arm 320. The biasing device 310 rotates the arm 320 based on the signal. In this way, the control device 420 may rotate the arm 320. Also, in this case, it is important for the supporters 330 to maintain the attitude of the flying object 1, and the rotation direction 210 of the arm 320 can be optionally selected.

Also, an example has been shown in which the guide 130 is inclined to evacuate from the region of the movement of the flying object 1. However, the present invention is not limited to this. It is enough that the guide 130 can evacuate from the region of the movement of the flying object 1, when the rear section 20 of the flying object 1 reaches the position of the guide 130. For this purpose, an optional method can be selected. For example, when the flying object 1 reaches a predetermined position, the arm 320 of the guide 130 may be folded. Specifically, the launch tube 100 has the detection sensor and the control device which controls the arm 320. The detection sensor detects the position of the flying object 1. The control device determines whether or not the flying object 1 has reached the predetermined position, based on the detection result of the detection sensor. The control device controls to fold the arm 320 when determining that the flying object 1 has reached the predetermined position.

An example has been shown in which the arm 320 is supported by the biasing device 310. However, the present invention is not limited to this. For example, the arm 320 may be installed on the inner wall 110*a*. In this case, the biasing device 310 may apply the rotation force to the arm 320.

An example has been shown in which the steering wings 11 are arranged on the diagonal lines of the launch tube 100. However, the present invention is not limited to this. The guide 130 contacts the front section side surface 10*a*, the dorsal fin side surface 12*a*, the protruding section end surface 15*a* and so on. If the attitude of the flying object 1 can be maintained, the arrangement of the steering wings 11 can be optionally selected. Also, the flying object 1 may be stored in the launch tube 100 in the condition that the steering wings 11 are folded.

In the above description, the order and processing content of each step may be changed in a range without obstructing the function. Also, the described configuration may be changed optionally in a range without obstructing the function. For example, the shapes of the front section 10, rear section 20 and joint section 30 can be optionally selected. Also, the arrangement and shape of the rail 120 may be selected optionally if the attitude of the flying object 1 can be maintained.

What is claimed is:

1. A launch tube comprising:

a tube configured to store a flying object;

a plurality of rails fixed on an inner wall of the tube and configured to contact the flying object; and a plurality of guides on the inner wall of the tube, wherein:

a first of the plurality of guides is configured to contact the flying object;

the first of the plurality of guides is configured to evacuate from a movement region of the flying object, when the flying object moves to leave the first of the plurality of guides;

the first of the plurality of guides includes a supporter configured to contact the flying object when guiding the flying object, an arm configured to support the supporter and protrude from the inner wall of the tube, and a biasing device configured to rotatably support the arm;

the biasing device is configured to bias the arm in a first direction to push the supporter against the flying object, when the supporter contacts the flying object;

the biasing device is configured to rotate the arm in the first direction to move the supporter toward the inner wall of the tube, when the flying object leaves the supporter; and the supporter is configured to move toward the inner wall of the tube from a first position in which the supporter contacts the flying object through a second position which is further from the inner wall of the tube in a second direction than the first position, the second direction extending from the inner wall of the tube to the flying object.

2. The launch tube according to claim 1, wherein the supporter is configured to contact a protruding section on a surface of the flying object, the protruding section extending in a progressing direction of the flying object.

3. The launch tube according to claim 1, wherein:

the supporter is configured to contact a dorsal fin of the flying object; and the biasing device is configured to rotate the arm to move the supporter toward a tip of the dorsal fin, when the dorsal fin leaves the supporter.

4. The launch tube according to claim 3, wherein:

a direction of a rotation axis of the arm is different from a progressing direction of the flying object; and an angle between a direction orthogonal to the direction of the rotation axis of the arm and the progressing direction of the flying object, and a direction of a normal line to a tangential plane of the flying object and the supporter is larger than 30 degrees and smaller than 55 degrees.

5. The launch tube according to claim 1, wherein the arm is inclined in a progressing direction of the flying object.

6. The launch tube according to claim 1, wherein:

a line segment which links a contact point between the supporter and the flying object when the first guide contacts the flying object and a rotation axis of the arm is a contact point line segment;

an intersection line of a tangential plane of the flying object at the contact point and a plane which is orthogonal to the rotation axis of the arm and passes through the contact point is a contact point intersection line; and an angle between the contact point line segment and the contact point intersection line is smaller than 90 degrees.

7. The launch tube according to claim 1, wherein:

the tube has an opening, and a separation wall detachable to the opening; and a second of the plurality of guides is on the separation wall.

8. The launch tube according to claim 1, wherein at least one of the plurality of guides is configured to be slidable on the inner wall of the tube when the flying object is stored, and fixed on the inner wall of the tube when the flying object is launched.

9. The launch tube according to claim 1, wherein:

the tube has a door opening to an outside direction of the tube on the inner wall on which at least one of the plurality of guides is positioned; and the door is configured to open when the flying object is being stored in the tube and close after the flying object is stored in the tube.

10. A method of launching a flying object, the method comprising:

maintaining an attitude of the flying object by making a plurality of rails and a plurality of guides contact the flying object, when the flying object is launched from a launch tube; and evacuating at least a first of the plurality of guides from a region of movement of the flying object when the flying object moves to leave the plurality of guides, wherein:

the plurality of rails are fixed on an inner wall of the launch tube;

the plurality of guides are on the inner wall of the launch tube;

the first of the plurality of guides includes a supporter configured to contact the flying object when guiding the flying object, an arm configured to support the supporter and protrude from the inner wall of the launch tube, and a biasing device configured to rotatably support the arm;

the maintaining the attitude of the flying object includes biasing, by the biasing device, the arm in a first direction to push the supporter against the flying object;

the evacuating at least the first of the plurality of guides from the region of movement of the flying object includes rotating, by the biasing device, the arm in the first direction and moving the supporter toward the inner wall of the launch tube; and the moving the supporter toward the inner wall of the launch tube includes moving the supporter from a first position in which the supporter contacts the flying object through a second position which is further from the inner wall of the launch tube in a second direction than the first position, the second direction extending from the inner wall of the launch tube to the flying object.

11. The method according to claim 10, wherein:

the flying object includes a first part configured to contact the supporter before launching the flying object and a second part behind the first part, a first length between the first part and the inner wall of the launch tube being longer than a second length between the second part and the inner wall of the launch tube; and the evacuating at least the first of the plurality of guides from the region of movement of the flying object includes moving the supporter in the first direction by the biasing device when the second part of the flying object reaches a position of the first of the plurality of guides.

12. The method according to claim 11, wherein the first part of the flying object is included in a dorsal fin.

13. A launch tube comprising:

a tube configured to store a flying object;

a plurality of rails fixed on an inner wall of the tube and configured to contact the flying object; and a plurality of guides on the inner wall of the tube, wherein:

a first of the plurality of guides includes a supporter configured to contact the flying object, an arm configured to support the supporter and protrude from the inner wall of the tube, and a biasing device configured to rotatably support the arm;

the biasing device is configured to bias the arm in a first direction to push the supporter against the flying object, when the supporter contacts the flying object;

the biasing device is configured to rotate the arm in the first direction to move the supporter toward the inner wall of the tube, when the flying object leaves the supporter; and the supporter is configured to move toward the inner wall of the tube from a first position in which the supporter contacts the flying object through a second position which is further from the inner wall of the tube in a second direction than the first position, the second direction extending from the inner wall of the tube to the flying object.

* * * * *